US011015616B2

(12) United States Patent
Hoffmann et al.

(10) Patent No.: US 11,015,616 B2
(45) Date of Patent: May 25, 2021

(54) LIQUID HEATING PUMP FOR CONVEYING AND HEATING LIQUID IN A WATER-BEARING DOMESTIC APPLIANCE

(71) Applicant: BSH Hausgeräte GmbH, Munich (DE)

(72) Inventors: Igor Hoffmann, Dillingen (DE); Stephan Lutz, Sontheim (DE); Hans-Holger Pertermann, Dresden (DE); Markus Wecker, Gundremmingen (DE)

(73) Assignee: BSH Hausgeräte GmbH, Munich (DE)

( * ) Notice: Subject to any disclaimer, the term of this patent is extended or adjusted under 35 U.S.C. 154(b) by 294 days.

(21) Appl. No.: 16/094,227

(22) PCT Filed: Apr. 25, 2017

(86) PCT No.: PCT/EP2017/059782
§ 371 (c)(1),
(2) Date: Oct. 17, 2018

(87) PCT Pub. No.: WO2017/194301
PCT Pub. Date: Nov. 16, 2017

(65) Prior Publication Data

US 2019/0093671 A1 Mar. 28, 2019

(30) Foreign Application Priority Data

May 10, 2016 (DE) ..... 102016208017.2

(51) Int. Cl.
*F04D 29/58* (2006.01)
*F04D 29/42* (2006.01)
(Continued)

(52) U.S. Cl.
CPC ..... *F04D 29/588* (2013.01); *A47L 15/4225* (2013.01); *A47L 15/4285* (2013.01);
(Continued)

(58) Field of Classification Search
CPC .. F04D 29/588; F04D 13/0606; F04D 29/426; F04D 29/448; A47L 15/4225;
(Continued)

(56) References Cited

U.S. PATENT DOCUMENTS 8,899,918 B2 * 12/2014 Weber ..... F04D 29/426 415/211.2
9,145,901 B2 * 9/2015 Li ..... D06F 39/085
(Continued)

OTHER PUBLICATIONS

International Search Report PCT/EP2017/059782 dated Jul. 20, 2017.

*Primary Examiner* — David E Sosnowski
*Assistant Examiner* — Sabbir Hasan
(74) *Attorney, Agent, or Firm* — Michael E. Tschupp; Andre Pallapies; Brandon G. Braun

(57) ABSTRACT

A liquid heating pump includes an impeller chamber having an impeller, which can be rotatably driven, and a diffusor chamber and/or pressure chamber arranged axially downstream in the flow direction and having a stationary diffusor. A heating device is associated with the diffusor and/or pressure chamber. The diffusor has a main body, in particular in the shape of a circular cylinder. The main body has a front wall on which a guide blade portion is arranged which axially protrudes in a direction of the impeller into a liquid ejection region of the impeller arranged around an outer periphery of the impeller and which extends away from the liquid ejection region outwardly toward an axial outer casing of the main body, which axial outer casing is arranged radially further outwardly than the liquid ejection region of the impeller.

30 Claims, 8 Drawing Sheets

(51) Int. Cl.

| | |
|---|---|
| ***F04D 29/44*** | (2006.01) |
| ***A47L 15/42*** | (2006.01) |
| ***D06F 39/04*** | (2006.01) |
| ***D06F 39/08*** | (2006.01) |
| ***F04D 13/06*** | (2006.01) |

(52) U.S. Cl.
CPC ..... *D06F 39/04* (2013.01); *D06F 39/085* (2013.01); *F04D 13/0606* (2013.01); *F04D 29/426* (2013.01); *F04D 29/448* (2013.01); *D06F 39/083* (2013.01)

(58) Field of Classification Search
CPC ... A47L 15/4285; D06F 39/04; D06F 39/085; D06F 39/083
See application file for complete search history.

(56) References Cited

U.S. PATENT DOCUMENTS

| | | | |
|---|---|---|---|
| 2010/0126534 | A1 | 5/2010 | Buesing et al. |
| 2012/0224961 | A1 | 9/2012 | Weber et al. |
| 2012/0263581 | A1 | 10/2012 | Li et al. |
| 2013/0287561 | A1 | 10/2013 | Block et al. |

* cited by examiner

LIQUID HEATING PUMP FOR CONVEYING AND HEATING LIQUID IN A WATER-BEARING DOMESTIC APPLIANCE

CROSS-REFERENCES TO RELATED APPLICATIONS

This application is the U.S. National Stage of International Application No. PCT/EP2017/059782, filed Apr. 25, 2017, which designated the United States and has been published as International Publication No. WO 2017/194301 A1 and which claims the priority of German Patent Application, Serial No. 10 2016 208 017.2, filed May 10, 2016, pursuant to 35 U.S.C. 119(a)-(d).

BACKGROUND OF THE INVENTION

In particular in household dishwashers what is known as a liquid heating pump is frequently provided in each case, said liquid heating pump comprising a circulating pump and additionally a heating device in combination therewith. Thus, on the one hand, washing liquid may be pumped by means of the circulating pump via one or more supply lines to one or more spray devices in the interior of the washing container of the household dishwasher and, on the other hand, the washing liquid which is conveyed by means of the circulating pump and which is to be sprayed may be heated by the heating device to a required heated temperature if this is necessary in the respective partial wash cycle—such as for example the cleaning cycle or the rinse cycle—of a wash cycle to be carried out.

Such a liquid heating pump is disclosed, for example, in WO 2008/125488 A2. The liquid heating pump provided therein is configured according to the functional principle of a centrifugal pump and/or radial pump. Said liquid heating pump comprises a centrally arranged suction channel, viewed along the flow path of the liquid conveyed in pumping mode, an impeller chamber arranged downstream thereof in the flow direction of the conveyed liquid, with a rotatably driven impeller, in particular a bladed impeller, after an approximately 180° deflection of the conveyed liquid an annular cylindrical diffusor and/or pressure chamber which is arranged downstream of the impeller chamber and which is coaxially arranged externally around a partial portion of the suction channel, a tubular heating device which forms a partial portion of the outer defining wall of the diffusor and/or pressure chamber and a discharge port on the outlet side. In the diffusor and/or pressure chamber a stationary guide apparatus with a ring and guide blades integrally formed on the outer casing thereof is provided downstream of the liquid outlet region of the impeller as a partial portion of the internal defining wall thereof, said guide blades facing radially outwardly and optionally being slightly spring-loaded. Rotary movement components of the liquid conveyed by the impeller are converted into axial movement components by means of the radially protruding guide blades of this guide apparatus, i.e. the flow component of the liquid conveyed by the impeller increases in the axial direction.

In spite of such an annular guide apparatus with radially outwardly protruding guide blades, the pumping capacity of this liquid heating pump may be insufficient under some circumstances. In particular, the aeration behavior of such a liquid heating pump in some cases—such as for example when starting up the rotational operation of the pump after a stoppage phase—may be insufficient. Associated therewith, it may result in the conveyed liquid not being able to flow through the heating device faultlessly or sufficiently, so that the heat dissipation of the heating power provided by the heating device may be impaired.

The heating pump of EP 2 495 444 A1 operating according to the functional principle of a centrifugal pump, suctions water to be conveyed via a central axial tubular inlet which transitions into a pump cover on the inlet side when the impeller is driven and rotates. At the same time the impeller conveys the water radially and with a speed component in the peripheral direction into a pumping chamber. The outer chamber wall thereof is heated. The impeller extends with its lower face, i.e. viewed in the suction direction, with its rear impeller disk above a pump base, the drive motor of this heating pump being located below said pump base and the impeller being located on the axis of said drive motor. One or more stationary flow guide blades are arranged radially outside the impeller, said flow guide blades extending in a helical manner with a pitch extending in the rotational direction of the impeller away from the pump base. In this case, at least one of the helically extending flow guide blades extends as far as the lower face, i.e. viewed in the suction direction as far as the rear cover disk of the impeller. The one or more helically extending flow guide blades are advantageously provided so as to protrude radially outwardly on the external periphery of a peripheral support ring which is arranged substantially radially outside an upper region, i.e. radially outside a front region of the impeller viewed in the suction direction. This support ring is pushed at that point onto the pump cover on the inlet side, where it forms a partial portion of an internal defining wall of the pump chamber. In this case the at least one flow guide blade, which protrudes as far as the lower face of the impeller and extends in a helical manner, projects in the axial direction over the support ring. So that this flow guide blade reaches as far as the lower face of the impeller, it is necessary for the external diameter of the support ring to be adapted to the external diameter of the lower face of the impeller. This measure may be disadvantageous for some constructions of liquid heating pumps. Additionally, even in this pump of EP 2 495 444 B1 during the rotational operation thereof it may still result in air collecting in the center of the impeller which is only able to be removed slowly from the pump chamber insufficiently or inadequately, which leads to a reduction in the desired target pumping capacity of this heating pump. This becomes all the more critical, the smaller the external diameter of the impeller is selected to be relative to the diameter of the support ring with the one or more radially outwardly protruding helical flow guide blades and/or the greater the rotational speed of the impeller is selected to be during rotational operation. This means that in some circumstances the specific construction of this pump is insufficient for the requirements of liquid heating pumps which are constructed differently therefrom.

BRIEF SUMMARY OF THE INVENTION

The object of the invention is to provide an alternative, improved liquid heating pump for conveying and heating liquid in a household appliance which uses water, in particular a household dishwasher heating pump or washing machine heating pump.

This object is achieved by the following liquid heating pump according to the invention:

A liquid heating pump for conveying and heating liquid in a household appliance which uses water, in particular a household dishwasher heating pump or washing machine heating pump, comprising a centrally arranged suction channel for suctioning the liquid in an axial suction direction and supplying the suctioned liquid into an impeller chamber arranged axially downstream, comprising an impeller which can be driven in a rotating manner in the impeller chamber for conveying the liquid into a diffusor and/or pressure chamber arranged axially downstream, viewed counter to the suction direction, and which is arranged externally, in particular coaxially, at least around a partial portion of the suction channel, comprising a stationary diffusor in the diffusor and/or pressure chamber, wherein the diffusor comprises a main body, in particular in the shape of a circular cylinder, the front wall thereof facing the impeller chamber forming a front defining wall of the impeller chamber, and wherein the main body of the diffusor on its front wall facing the impeller chamber, positionally defined by its outer periphery, comprises one or more guide blade portions which axially protrude in the direction of the impeller and which in each case protrude into a liquid ejection region of the impeller arranged around the outer periphery of the impeller and in each case extend outwardly therefrom, in particular positioned obliquely, deviating from the radial direction in the impeller direction toward the axial outer casing of the main body, in particular as far as the axial outer casing of the main body which is arranged further radially outwardly than the liquid ejection region of the impeller, comprising a heating device associated with the diffusor and/or pressure chamber for heating the conveyed liquid, wherein the heating device in particular comprises at least one, preferably axially extending, partial portion of an external defining wall of the diffusor and/or pressure chamber and the axial outer casing of the main body of the diffusor in particular forms at least one, preferably axially extending, partial portion of an internal defining wall of the diffusor and/or pressure chamber, and comprising a discharge port for ejecting the liquid.

This liquid heating pump constructed according to the invention is further improved, in particular, relative to its aeration behavior. By means of the one or more guide blade portions which, positionally defined by the outer periphery of the diffusor main body, protrude from the front wall thereof facing the impeller chamber in an axial manner in the direction of the impeller as far as the peripheral liquid ejection region thereof, in particular an air bubble may be substantially prevented from flowing back out of the diffusor and/or pressure chamber, in particular radially inwardly, into the center of the impeller chamber when the impeller is rotatably driven.

Since the front wall surface of the diffusor main body which faces the impeller chamber comprises one or more guide blade portions inside its outer edge, which protrude axially in the direction of the impeller and project in the peripheral liquid ejection region thereof and respectively extend away therefrom outwardly toward the axial outer casing of the main body, in particular as far as the axial outer casing of the main body which is arranged further radially outwardly than the liquid ejection region of the impeller but not beyond the axial outer casing of the main body in the radial direction, in terms of flow guidance the liquid conveyed out of the impeller may be advantageously acted upon, preferably with a radial and circular speed component, for the introduction thereof into the diffusor and/or pressure chamber. In particular, by means of these one or more axially protruding guide blade portions on the front wall side, the formation of a liquid flow moving forward in a helical manner through the diffusor and/or pressure chamber may be assisted. It is now possible to arrange and to dimension the diffusor and/or pressure chamber substantially independently of the impeller, in particular of the geometric shape, position and/or size thereof, in particular the external diameter thereof. In particular, the diffusor and/or pressure chamber, viewed outwardly in the radial direction, may be removed relatively far from the outer periphery of the impeller, preferably significantly further than in the stationary guide apparatuses disclosed in the prior art, such as for example WO 2008/125488 A2, EP 2 495 444 B1, comprising one respective ring, radially outwardly facing guide blades being integrally formed on the outer casing thereof. The diffusor construction according to the invention preferably makes it possible to fix the diameter of the internal defining wall of the diffusor and/or pressure chamber and thus—if this is expediently formed at least partially by the axial outer casing of the diffusor main body—the diameter of the axial outer casing of the main body of the diffusor and/or the diameter of the outer defining wall of the diffusor and/or pressure chamber substantially independently of the external diameter of the impeller and to be larger than said external diameter of the impeller. In particular, the diameter of the internal defining wall of the diffusor and/or pressure chamber and/or the external diameter of the axial outer casing of the preferably elongated, preferably circular cylindrical main body which extends in the axial direction, may be selected to be larger than the external diameter of the impeller by at least 25%, preferably between 40% and 100%, preferably by approximately 50%. Expediently, the impeller has an external diameter which is selected to be between 40% and 80%, in particular between 60% and 70%, of the diameter of the axial outer casing, in particular, of the circular cylindrical main body of the diffusor.

In general terms, the diffusor configured according to the invention advantageously provides degrees of freedom in the local positioning and/or dimensioning of the cross-sectional passage surface of the diffusor and/or pressure chamber. This is primarily advantageous if the heating device forms at least one preferably axially extending partial portion of the outer defining wall of the diffusor and/or pressure chamber, in order to be able to ensure a sufficient flow of liquid through this heated partial portion of the outer defining wall for fault-free dissipation of the heating power provided there. Thus, by a reduction in the preferably circular cross-sectional passage surface of the diffusor and/or pressure chamber, in particular the flow speed of the liquid moving forward in the axial direction through the diffusor and/or pressure chamberin a helical manner, may be increased in order to be able to dissipate the thermal heating power provided at that point by the heating device without faults.

By means of the one or more guide blade portions axially protruding from the front wall of the diffusor main body and protruding into the liquid ejection region of the impeller, it is now advantageously possible also to increase significantly the diameter of the impeller chamber relative to the external diameter of the impeller, and namely in particular significantly more than the radial clearance generally required for the free rotatability of the impeller. In this manner, an initial portion of the heating device may even be accommodated in the impeller chamber, said heating device thus extending further into the diffusor and/or pressure chamber arranged downstream. In particular, an initial portion of the heating device forms a partial portion or the entire portion of the outer defining wall of the impeller chamber. In this manner, the axial length of such an advantageously configured liquid heating pump may be shortened relative to the axial length of previous liquid heating pumps so that less installation space is required therefor in the household appliance (in comparison with a construction in which the initial portion of the heating device only starts in the diffusor and/or pressure chamber), such as for example in the floor subassembly of a dishwasher. Preferably, the diameter of the impeller chamber is selected to be approximately the same as the diameter of the outer defining wall of the diffusor and/or pressure chamber. Then, in particular, the dimensional ratios specified above between the impeller external diameter and the diameter of the diffusor axial outer casing correspondingly apply to the ratio between the impeller external diameter and the external diameter of the impeller chamber.

In contrast to the support ring with the one or more helical guide blades of EP 2 495 444 B1 protruding radially outwardly on the outer periphery thereof, in the liquid heating pump according to the invention, (when viewing the front wall surface of the diffusor main body facing the impeller chamber) the respective guide blade portion axially protruding in the direction of the impeller chamber approximately extends away from the outer periphery of the impeller and/or impeller wheel only to a region located further radially outwardly relative thereto inside the front wall surface encompassed by the outer periphery of the main body, in particular only as far as the outer periphery of the front wall surface of the diffusor main body, but not further in the radial direction. This means that it bridges the radial distance between the circular and/or peripheral liquid ejection region predetermined by the outer periphery of the impeller and a circle located further radially outwardly, i.e. removed at a radial distance, which is arranged concentrically to the circular liquid ejection region and, in particular, corresponds to the outer peripheral circle of the preferably circular cylindrical main body. When viewed in the viewing direction perpendicular to the front wall surface of the main body, it extends only between the circular liquid ejection region and the outer peripheral circle of the main body located relative thereto. It does not protrude from this outer peripheral circle, however, in the radial direction but it is arranged inside the defining surface of the front wall encompassed by this outer peripheral circle. It protrudes, positionally defined by the outer periphery of the main body, from the front wall surface thereof which is preferably configured substantially as a normal plane to the rotational axis of the impeller, with an axial extension component, i.e. in the normal direction as far as the peripheral liquid ejection region of the impeller, and viewed in the normal plane or a plane parallel thereto, does not exceed the outer periphery of the front wall surface.

Within the scope of the invention, "the peripheral liquid ejection region of the impeller" is understood, in particular, as the area around the outer periphery of the impeller from which the liquid is conveyed outwardly between the gaps of the impeller blades thereof, in particular with a radial and a circular speed component, when the impeller is rotatably driven. This corresponds in particular, to a circle which is fixed by the ends of the impeller blades.

As a stationary diffusor comprising a main body, which is preferably elongated in the axial direction and in particular is circular cylindrical, is provided in the diffusor and/or pressure chamber, in which on the front wall facing the impeller chamber, positionally defined by the outer periphery thereof, one or more guide blade portions axially protrude in the direction of the impeller such that in each case they protrude into a liquid ejection region of the impeller which is arranged around the outer periphery of the impeller, and in each case extend outwardly away therefrom, in particular positioned obliquely and/or inclined in the impeller direction, deviating from the radial direction, toward the axial outer casing of the main body, in particular as far as the axial outer casing of the main body, which is arranged further radially outwardly than the liquid ejection region, during the rotational operation of the impeller, defined flow guide paths of the liquid conveyed outwardly thereby and also any air bubbles contained therein and/or entrained thereby away from the liquid ejection region of the impeller, are predetermined in the direction, in particular, of the further radially outwardly located axial outer casing of the main body relative to this liquid ejection region. These one or more axially protruding guide blade portions promote the removal of the liquid emitted and/or ejected by the rotatably driven impeller and any air bubbles contained therein or entrained thereby away from the liquid ejection region of the impeller out of the impeller chamber into the diffusor and/or pressure chamber arranged downstream thereof counter to the suction direction, i.e. in the outflow direction.

In particular, when in each case the guide blade portions have a path which is not shaped as a circular arc portion and which deviates from the radial direction, they reduce or prevent the formation of a 360° or repeated 360° circulation and/or vortex flow of the liquid ejected by the impeller during the rotational operation thereof around the outer periphery thereof. This is because, due to their path which is not shaped as a circular arc portion and which deviates from the radial direction, they subdivide the peripheral impeller chamber region around the outer periphery of the impeller into a plurality of sectors which are separate from one another. The one or more axially protruding guide blade portions thus extend away from the peripheral liquid ejection region of the impeller outwardly toward the axial outer casing of the main body, in particular as far as the axial outer casing of the main body, expediently such that they reduce the turbulence of the circulating flow which is otherwise present around the impeller during the rotational operation thereof. In other words, they counteract the formation of a rotational flow in which the liquid ejected outwardly from the impeller during the rotational operation thereof circulates and/or passes around this impeller once or repeatedly. Instead, the path of the respective axially protruding guide blade portion is preferably selected such that the liquid ejected on the periphery and/or outer periphery of the impeller, during the rotational operation thereof, only passes through a peripheral angle of less than 360°, in particular between 45° and 180°, preferably between 50° and 135°, viewed from its outlet point on the outer periphery of the impeller, as far as the axial outer casing of the main body of the diffusor arranged further radially outwardly relative thereto. The one or more axially protruding guide blade portions thus limit the circular and/or peripheral path of the liquid ejected from the impeller with a radial component and a rotational component in the peripheral direction to a fraction of a full 360° circle. The impeller chamber, viewed around the outer periphery of the impeller, is subdivided by the one or more axially protruding guide blade portions approximately into a plurality of chambers and/or sectors and as a result the formation of a circulation flow in which the liquid ejected by the impeller circulates once or repeatedly over the periphery thereof is reduced or prevented.

With the diffusor construction according to the invention, in particular air may be prevented in an improved manner from collecting in the center of the impeller chamber, in particular around the hub of the impeller, during rotational operation of the impeller when conveying liquid. The one or more axially protruding guide blade portions ensure that air which, for example, after a stoppage phase of the impeller is present in a cavity of the diffusor and/or pressure chamber, said cavity being free of liquid, is able to flow back into the center of the impeller chamber when starting up and/or starting the impeller. If during the operation of the liquid pump of the liquid heating pump configured according to the invention it results in the suctioning of air, i.e. if air bubbles are contained in the liquid suctioned through the suction channel into the interior of the impeller, the one or more axially protruding guide blade portions facilitate the removal thereof by the liquid conveyed from the impeller chamber into the diffusor and/or pressure chamber, through said chamber and then out of the discharge port. This is because the respective axially protruding guide blade portion conducts an air bubble contained in the conveyed liquid, preferably in the manner of an obliquely positioned ramp or other flow guidance element relative to the radial direction in the running direction of the impeller, away from the peripheral liquid ejection region of the impeller outwardly to the axial outer casing of the main body of the diffusor, in particular as far as the axial outer casing of the main body which is arranged further radially outwardly than the liquid ejection region of the impeller. Since the respective axially protruding guide blade portion protrudes at least with its further radially inwardly arranged initial portion into the peripheral liquid ejection region of the impeller, i.e. viewed in the axial direction it covers this partially or completely from outside, an air bubble conveyed from the impeller chamber into the diffusor and/or pressure chamber is also no longer able to flow back radially inwardly to the center of the impeller chamber and collect at that point. The liquid heating pump according to the invention is characterized, therefore, by an improved aeration behavior with a shorter aeration time, both in the course of the liquid conveying operation and when starting and/or starting up the impeller. Without the one or more guide blade portions arranged inside the outer periphery of the front wall of the main body, protruding axially into the impeller chamber, however, it might lead to a separation of liquid and air during the rotational operation of the impeller due to the centrifugal forces becoming effective by the circulation flow which is being created. In this case, due to its lower density relative to the liquid, the air would collect in the center of the impeller chamber, in particular around the hub and/or shaft of the impeller, which would impair or interrupt the liquid throughflow of such a conventionally constructed liquid heating pump and thus would impair the liquid pumping capacity thereof. In contrast thereto, in the liquid heating pump constructed according to the invention, during the rotational operation of the impeller it results in much less air collecting in the center of the impeller chamber around the hub or the shaft of the impeller, or none at all, and namely not when the air on the input side is suctioned into the centrally arranged suction channel of the liquid heating pump during the conveyance of the liquid. This may be the case, for example, when the liquid level in the suction channel is lower than the internal height of the suction channel, so that above the liquid level an air-filled empty space remains in the suction channel. This is because the one or more guide blade portions, which axially protrude on the front wall of the main body in the direction of the impeller chamber, in the peripheral part of the impeller chamber around the outer periphery of the impeller in the impeller chamber, provide flow guidance means for deflecting the conveyed liquid and any air bubbles entrained therewith from the liquid ejection region of the impeller along defined flow guidance paths and/or guide paths to the axial outer casing of the main body and thus into the diffusor and/or pressure chamber. Thus the liquid in the impeller chamber is prevented from being able to pass once or repeatedly around the impeller and from being able to form a circulation flow which circulates once or repeatedly, and which would lead to the separation of the liquid and air by the active centrifugal forces (due to the different densities thereof). The liquid ejected from the impeller with a radial and a circular speed component, i.e. speed component in the peripheral direction, may flow only in a partial portion, in particular a sector portion of the preferably rotationally symmetrical, in particular approximately circular cylindrical, impeller chamber, which is defined by a first axially protruding guide blade portion and a downstream second axially protruding guide blade portion, viewed in the rotational direction of the impeller. If the respective axially protruding guide blade portion preferably extends obliquely relative to the radial direction in the rotational direction of the impeller, a liquid flow runs towards said guide blade portion from the liquid ejection region of the impeller which is located between the first and the second axially protruding guide blade portion, from the outer periphery of the impeller in the outward direction, in particular as far as the axial outer casing of the main body, into the diffusor and/or pressure chamber. In this case, air bubbles which are also contained in the liquid are forced by the liquid via the respective guide blade portion which is downstream of the liquid outlet location in the rotational direction, in particular positioned obliquely relative to the radial direction in the rotational direction, out of the impeller chamber into the diffusor and/or pressure chamber by the conveyed liquid. Thus air bubbles suctioned into the suction channel on the input side may flow through the liquid heating pump constructed according to the invention and may be conveyed out of the discharge port on the output side with a shorter throughflow time than might be possible with a conventional liquid heating pump with a diffusor, which does not have any guide blade portions which axially protrude in the direction of the impeller on its the front wall facing the impeller chamber.

In particular, the path of the respective guide blade portion axially protruding from the front wall of the main body facing the impeller chamber is selected such that it is effective in a radial manner for the liquid conveyed by a radial and a circular speed component out of the impeller. In particular, even in this case a proportion of the kinetic energy provided to the liquid by the rotating impeller is optionally converted into dynamic pressure.

In particular, when the respective axially protruding guide blade portion extends so as to deviate from the radial direction, the liquid ejected from the rotating impeller contains a portion of its circular speed component and is not fully decelerated in the rotational direction of the impeller. In particular, when the respective axially protruding guide blade portion extends so as to deviate from a circular arc portion extending in the peripheral direction of the front wall, which follows the impeller rotational direction (and thus not in the form of a concentric circular portion), the liquid may be subjected to a deflection with a radial directional component in the direction of the axial outer casing of the main body and/or the outer defining wall of the impeller chamber. In particular, at the same time the kinetic energy induced by the rotatably driven impeller into the liquid is optionally partially converted into dynamic pressure. In this manner, the liquid entering the diffusor and/or pressure chamber contains a sufficiently large proportion of the kinetic energy provided thereto by the impeller, so that the heating device assigned to the diffusor and/or pressure chamber may be subjected to a sufficiently rapid liquid flow which flows past. This twists around the axial outer casing of the preferably circular cylindrical main body in a helical manner and/or spiral-shaped manner through the preferably circular cylindrical diffusor and/or pressure chamber to the discharge port on the outlet side. Thus it moves along this helical movement path with an axial and a circular flow speed component through the diffusor and/or pressure chamber. As a result, it is ensured that—in particular if the heating device forms a partial portion or the entire portion of the outer defining wall of the diffusor and/or pressure chamber—the electrical heating power provided by the heating device, viewed in the peripheral direction and in the axial direction, may be substantially uniformly and reliably removed by the liquid conveyed in pumping mode without it resulting in local overheating of the heating device. Moreover, less limescale may be deposited thereby on the heating device.

According to an advantageous development of the invention, it is advantageous in terms of flow technology if the respective guide blade portion, which axially protrudes on the front wall of the main body facing the impeller chamber and/or the suction side of the impeller, extends from its further radially inwardly arranged initial portion to its further radially outwardly arranged end relative thereto in the form of a preferably outwardly opening arcuate portion, in particular circular arc portion or preferably spiral portion or helical portion, positioned obliquely in the impeller rotational direction relative to the radial direction, in the plane encompassed by the outer periphery of the front wall of the main body and/or a plane parallel thereto. Such a shape of the path of the respective axially protruding guide blade portion advantageously promotes the removal of the conveyed liquid from the peripheral outer periphery of the impeller into a flow path which (viewed in the viewing direction from the impeller perpendicular to the front wall of the main body facing the impeller chamber) leads in a helical manner from the liquid ejection region of the impeller to the axial outer casing of the main body and then transitions into a movement path which, in the axial direction from the impeller chamber through the preferably circular cylindrical diffusor and/or pressure chamber, continues by circulating around the axial outer casing of the main body in a helical manner.

Additionally or independently of these advantageous path shapes of the one or more axially protruding guide blade portions, it is particularly advantageous if, when viewing the front wall of the main body of the diffusor facing the impeller chamber, the respective axially protruding guide blade portion extends outwardly with its further radially inwardly located initial portion, substantially tangentially away from an internal peripheral point on the circle of the liquid ejection region of the impeller, and with its further radially outwardly located end portion opens substantially tangentially into an outer peripheral point on the outer peripheral circle of the axial outer casing of the main body which is different from this inner peripheral point. This advantageously promotes the removal of the conveyed liquid from the peripheral outer periphery of the impeller into a flow path to the axial outer casing of the main body and into the preferably circular cylindrical diffusor and/or pressure chamber, where it continues to circulate in a helical manner the preferably circular cylindrical axial outer casing of the main body in the axial direction.

In this connection, it may be advantageous, in particular, if the respective axially protruding guide blade portion extends, viewed in the plane of the front wall or a plane parallel thereto, in the form of a spiral portion, the radius of curvature thereof increasing from its further radially inwardly arranged initial portion to its further radially outwardly arranged end relative thereto.

According to an expedient development of the invention, the respective axially protruding guide blade portion protrudes sufficiently far from the front wall of the main body of the diffusor facing the impeller chamber in the direction of the impeller that it partially or fully covers the axial width of the liquid ejection region of the impeller from outside, at least along its initial portion facing the impeller liquid ejection region, in particular along its total extent. As a result, the hydraulic efficiency and the aeration behavior of the liquid pump according to the invention is further improved. This is because circular liquid leakage flows which, due to centrifugal forces associated with its circular and/or gyroscopic movement and the variable densities of the liquid, in particular water, and air for the demixing thereof, could therefore lead to an undesirable collection of air bubbles in the center of the impeller chamber when the impeller rotates during pumping mode of the liquid heating pump, are thus substantially prevented.

According to an expedient development of the invention, the axial outer casing of the main body of the diffusor forms at least one, in particular axially extending, partial portion of an internal defining wall of the diffusor and/or pressure chamber. Thus it is particularly advantageous if the, in particular circular cylindrical, main body of the diffusor has an axial outer casing, the diameter thereof being selected to be at least equal to 80%, in particular between 80% and 90%, preferably approximately equal to 86% of the external diameter of the diffusor and/or pressure chamber. As a result, the radial gap width of the annular gap-shaped diffusor and/or pressure chamber, viewed in cross section, may be reduced such that at that point the liquid flowing through has an increased flow speed along its preferably helical path, which is sufficient to dissipate in a reliable manner the electrical heating power which is provided by the heating device assigned to the diffusor and/or pressure chamber. As a result, local overheating and the damage associated therewith to the heating device is substantially prevented. This is advantageous, in particular, when the heating device forms an axially extending partial portion of the outer defining wall of the diffusor and/or pressure chamber and the axial outer casing (axial outer casing) of the main body of the diffusor forms an axially extending partial portion of the internal defining wall of the diffusor and/or pressure chamber. In this case, the heating device may be expediently configured as a heating tube extending in the axial direction.

Additionally, by this advantageous dimensioning of the diameter of the axial outer casing of the diffusor in comparison with the external diameter of the diffusor and/or pressure chamber, the dead space volume in the pump housing for the liquid to be conveyed is reduced. The reduction in the annular cross-sectional passage surface in the diffusor and/or pressure chamber is associated with an improved displacement effect for the liquid flowing through at that point. This results in a reduction in the total quantity of liquid present in the liquid heating pump according to the invention.

In particular, by the expansion of the external diameter of the main body of the diffusor to at least equal to 80%, in particular between 80% and 90%, preferably approximately equal to 86% of the external diameter of the diffusor and/or pressure chamber in comparison with a previous heating pump, such as for example corresponding to WO 2008/

125488 A2, with the same volumetric flow of conveyed liquid, the flow speed thereof in the diffusor chamber is preferably already increased from the axial initial portion of the diffusor and/or pressure chamber, such that the thermal heating power provided by the heating device may be transferred in a reliable manner and substantially fully to the liquid which flows past. In contrast to the previous heating pump, for example corresponding to WO 2008/125488 A2, the heating device may now be operated with a higher local heating power density. Due to the now increased volumetric throughflow, optionally a heating device with a shorter axial length than hitherto may be sufficient for the same thermal energy transfer.

It has been shown after tests have been successfully carried out for the mass production of household dishwashers that, in particular, a design of the liquid heating pump constructed according to the invention is advantageous, in which the internal diameter of the diffusor and/or pressure chamber and/or equally the external diameter of the, in particular, circular cylindrical diffusor main body, the axial outer casing thereof forming an axially extending partial portion of the internal defining wall of the diffusor and/or pressure chamber, is selected to be between 5.5 cm and 6.5 cm, in particular equal to approximately 6.2 cm, and the external diameter of the diffusor and/or pressure chamber, the outer defining wall thereof partially or in particular entirely being formed by the heating device, preferably a heating tube, is selected to be between 7 cm and 7.5 cm, in particular approximately equal to 7.3 cm. The external diameter of the impeller is in this case expediently selected to be between 3.8 and 4.4 cm, in particular equal to approximately 4.2 cm. The diffusor thereof which is configured according to the construction principle according to the invention comprises three axially protruding guide blade portions offset to one another in the direction of the impeller chamber in the peripheral direction by approximately 120°. In this liquid heating pump which has been successfully tested for mass production, the respective axially protruding guide blade portion expediently protrudes with an axial extent of between 3 mm and 8 mm, in particular of approximately 5 mm, on the front wall of the main body into the impeller chamber. This axial extent corresponds approximately to the axial width of the peripheral liquid ejection region of the impeller by adding on the axial gap dimension between the front wall of the main body facing the impeller chamber and the front face of the impeller on the suction side. When using a so-called closed impeller this is formed by the front cover disk thereof on the suction side. Advantageously throughflow times of at most 6 seconds, in particular of between 3 seconds and 6 seconds, preferably approximately 5 seconds, are permitted in this liquid heating pump for air bubbles suctioned via the suction channel.

According to an advantageous development of the invention, the heating device in the diffusor and/or pressure chamber, preferably on the partial portion formed thereby or the entire portion formed thereby of the outer defining wall of the diffusor and/or pressure chamber, provides an electrical surface heating load of between 30 W/cm$^2$ and 50 W/cm$^2$—in particular when using the liquid heating pump configured according to the invention in a household dishwasher. For the heat dissipation thereof by means of the liquid conveyed in pumping mode of the liquid heating pump, i.e. in rotational operation of the impeller thereof, the cross-sectional passage surface of the annular gap-shaped diffusor and/or pressure chamber is expediently selected to be between 8 cm$^2$ and 20 cm$^2$, in particular approximately 12 cm$^2$, when viewed in cross section.

In particular, when the impeller in particular with an external diameter of approximately 4.2 cm—as in the liquid heating pump successfully tested for mass production in household dishwashers—rotates at a rotational speed of between 3800 and 4500 rpm, preferably rotates at a speed of approximately 4200 rpm, then the volumetric throughput of conveyed liquid is so great that the heating power provided by the heating device may be transferred to the liquid flowing through said heating device, such that local overheating of the heating device which could lead to undesired limescale deposits, heat damage or even malfunction of the heating device, are substantially prevented. By increasing the flow speed of the liquid conveyed through the preferably annular gap-shaped diffusor and/or pressure chamber, viewed in cross section, the formation of limescale deposits on the heating device is counteracted and the removal of any limescale deposits already formed on the heating device is accelerated.

In particular, it may be expedient if the respective guide blade portion axially protruding in the direction of the impeller is provided, in particular integrally formed, on the front wall of the main body of the diffusor facing the impeller chamber and/or the suction side of the impeller, such that in each case, viewed from its further radially inwardly located initial portion to its further radially outwardly located end, it has an oblique position relative to the radial direction of the impeller passing through its initial portion, in the rotational direction thereof. For example, if three axially protruding guide blade portions are offset to one another by approximately 120° in the peripheral direction on the front face of the main body facing the impeller chamber, it has been shown by tests that it is expedient if the respective axially protruding guide blade portion, viewed from its further radially inwardly located initial portion to its further radially outwardly located end, has an oblique position of between 90° and 135°, preferably approximately 120°, relative to the radial direction of the impeller passing through its initial portion, in the rotational direction thereof. Then the liquid ejected from the impeller may entrain a large part of the kinetic energy applied thereto by the rotating impeller, along its preferably spiral portion-shaped flow path in the impeller chamber, from the peripheral liquid ejection region of the impeller to the axial outer casing of the main body located further outwardly relative thereto, into the diffusor and/or pressure chamber. It is particularly advantageous if the one or more guide blade portions axially protruding in the direction of the impeller in each case have a direction of curvature in the rotational direction of the impeller on the front wall of the main body of the diffusor facing the impeller chamber. As a result, the hydraulic efficiency of the liquid heating pump according to the invention may be further improved. This is because less kinetic energy, which has been applied to the liquid by means of the rotating impeller, in particular in the form of a radial and circular and/or azimuthal speed component, is lost when supplied from the impeller chamber into the diffusor and/or pressure chamber.

In practice it has been shown to be expedient—in particular for the liquid heating pump tested successfully for mass production in dishwashers—if three guide blade portions axially protruding in the direction of the impeller are provided, in particular are integrally formed, on the front wall of the main body of the diffusor facing the impeller chamber and/or the suction side of the impeller, such that in each case, viewed from their further radially inwardly located initial portion to their further radially outwardly located end, they extend in the peripheral direction in each case over an angular range of between 45° and 90°, and at the same time in the plane spanned by this front wall of the main body, or the plane parallel thereto, cover a radial distance, in particular of between 5 mm and 10 mm, which is present between the liquid ejection region of the impeller and the axial outer casing of the main body. The respective axially protruding guide blade portion thus serves as a lifting aid and/or flow guidance means for the liquid ejected out of the impeller further radially inwardly on the outer periphery of the impeller, into the further outwardly located diffusor and/or pressure chamber, viewed in the radial direction.

It may be advantageous, in particular, if a plurality of, in particular three, axially protruding guide blade portions are arranged offset to one another on the front wall of the main body facing the suction side of the impeller in the peripheral direction, in each case by approximately the same centering angle, such that a liquid guide channel leading outwardly to the axial outer casing of the main body is present between two respective adjacent axially protruding guide blade portions, viewed in the peripheral direction. With three axially protruding guide blade portions, they are expediently arranged offset to one another, viewed in the peripheral direction, in each case by approximately 120°. As a result, three liquid guide channels are provided, starting from the liquid ejection region of the impeller as far as the axial outer casing of the main body. As a result, the main body of the diffusor may be kept structurally simple and produced in a simple manner and yet around the outer periphery of the impeller the liquid ejected there may be already distributed particularly uniformly to the diffusor and/or pressure chamber which is circular in cross section, in particular.

It may be optionally advantageous if the radial outer edge zone of the front wall of the main body of the diffusor facing the suction side of the impeller transitions fluently into the axial longitudinal extent of the axial outer casing of the main body in the form of a rounded portion. As a result, the hydraulic efficiency of the liquid heating pump configured according to the invention is further improved since undesired losses of kinetic energy, which has been provided to the liquid from the rotating impeller, are prevented in a further improved manner when the liquid is introduced into the diffusor and/or pressure chamber.

Advantageously, the respective axially protruding guide blade portion may be arranged and configured on the front wall of the main body facing the impeller chamber such that at least with its initial portion, in particular along its entire extent, from outside it covers the liquid ejection region of the impeller on the outer periphery, substantially across the axial width thereof with a remaining radial gap which (viewed in the flow direction) in the region of its initial portion, in particular, is selected to be between 0.5 mm and 2 mm. This radial gap provides a sufficient clearance for the unhindered rotation of the impeller. At the same time the remaining radial gap is selected to be sufficiently small that the formation of a circular flow is substantially prevented around the impeller. Leakage flows circulating around the impeller are substantially prevented thereby so that the volumetric efficiency of the liquid heating pump is improved.

For a high level of hydraulic efficiency it is expedient if the one or more blades of the impeller in each case have an oblique position relative to the radial direction of the impeller counter to the rotational direction of the impeller, in particular a direction of curvature counter to the rotational direction of the impeller.

In order to keep losses of kinetic energy as low as possible when supplying the liquid emerging from the liquid ejection region of the impeller to the respectively axially protruding guide blade portion, according to an advantageous development of the invention it is expedient if an acute intermediate angle of at most 50°, in particular of between 30° and 45°, preferably of approximately 41°, is enclosed between the imaginary, in particular tangential, extension of the radial outer end portion of the respective blade of the impeller and the imaginary, in particular tangential, extension of the initial portion of the respective guide blade portion protruding from the front wall of the main body facing the impeller in the axial direction. This results in an improvement in the hydraulic efficiency of the liquid heating pump according to the invention.

According to a further expedient development of the invention, the further radially inwardly located initial portion of the respective guide blade portion of the main body, axially protruding on the front face, preferably has a contour which is different from the contour of the end of the respective blade of the impeller on the outlet side. As a result, an inadmissibly high level of noise excitation by the liquid ejected from the impeller at the end of the respective impeller blade and/or at the initial portion of the respective guide blade portion axially protruding on the front face may be substantially prevented. It may also be advantageous if the further radially inwardly located initial portion of the respective guide blade portion of the main body axially protruding on the front face extends in the form of a bevel transversely to the end contour of the end of the respective blade of the impeller on the outlet side or in the form of a rounded portion.

According to a further advantageous development of the invention, on the axial outer casing of the main body of the diffusor additionally one or more, in particular three, radially protruding guide blade portions are provided in the liquid flow in the diffusor and/or pressure chamber. According to an advantageous variant, in particular, these guide blade portions may be unconnected to the one or more axially protruding guide blade portions and thus in each case provided independently therefrom and separated by a gap. In the liquid heating pump specified above and successfully tested for mass production these radially protruding guide blade portions in each case are located between 2 and 3 mm from the axial outer casing of the main body, radially in the diffusor and/or the pressure chamber. Expediently, in each case they have such a path on the axial outer casing of the main body that they impose an axial directional component onto the liquid flowing into the diffusor and/or pressure chamber from the impeller chamber, i.e. they are configured to act axially on the liquid. They additionally serve, in particular, for converting at least one portion of the kinetic energy contained in the liquid into dynamic pressure. It may be advantageous, in particular, if the respective guide blade portion radially protruding on the axial outer casing side extends in the form of a spiral portion, in particular a helical portion. In this manner the liquid flow passes through the diffusor and/or pressure chamber such that at the same time it circulates around the diffusor main body and/or the internal defining wall of the diffusor and/or pressure chamber in a helical manner and/or helix-shaped manner with a pitch height and/or pitch in the axial direction. This is advantageous if the heating device, for example, forms a partial portion or the entire portion of the outer defining wall of the diffusor and/or pressure chamber. This is because both in the peripheral direction and in the axial longitudinal direction of the heating device a sufficient, in particular substantially uniform, removal of the thermal heating power provided by the heating device and the transfer to the conveyed liquid may be ensured. If air bubbles are entrained in the conveyed liquid, the helical portion and/or helix portion of the respective radially protruding guide blade portion on the axial outer casing side, viewed upstream, advantageously in particular produces a barrier which hinders or prevents the flow of any air bubbles present in the diffusor and/or pressure chamber counter to the axial pump outflow direction back into the impeller chamber.

Advantageously, a plurality of, in particular three, radially protruding guide blade portions, in each case in the form of spiral portions, are arranged offset to one another around the axial outer casing of the, in particular, circular cylindrical main body. Preferably, they are positioned separately from one another by approximately the same centering angle range. In this manner, the radially protruding guide blade portions, which are arranged to be substantially uniformly distributed in the peripheral direction of the axial outer casing, act on the liquid conveyed through the preferably annular gap-shaped diffusor and/or pressure chamber, viewed in cross section, in a substantially uniform manner. Moreover, they also serve in particular to prevent a direct short circuit flow path for the conveyed liquid on the path thereof from the inlet of the diffusor and/or pressure chamber to the discharge port. In this manner, the liquid flowing through the diffusor and/or pressure chamber along a helical path may be optimally heated by the heating device provided there.

In order to prevent an air bubble from being able to migrate back out of the diffusor and/or pressure chamber into the impeller chamber, it is expedient in particular if, when viewed in the direction of the front wall of the main body facing the impeller chamber and/or the suction side of the impeller, the respective guide blade portion radially protruding on the axial outer casing side extends on the axial outer casing of the main body of the diffusor at least in an outer peripheral region of the main body which is located between the further radially outwardly arranged end of a first axially protruding guide blade portion and the further radially inwardly arranged initial portion of a second axially protruding guide blade portion, arranged downstream when viewed in the rotational direction of the impeller. Thus by the respective radially protruding guide blade portion on the axial outer casing, an axial barrier in the rearward direction toward the impeller chamber is provided for an air bubble which is located downstream of this radially protruding guide blade portion approximately in the diffusor and/or pressure chamber or in the pressure chamber or discharge port arranged downstream thereof. This is advantageous, in particular, for fault-free aeration of the liquid heating pump when starting the pumping mode after a stoppage phase.

It may be advantageous, in particular, that an outlet, in particular for an end portion without guide blades of the axial outer casing of the main body, is present between the downstream end of the guide blade portion radially protruding on the axial outer casing side and the upstream end of a second downstream guide blade portion radially protruding on the axial outer casing side, viewed in the rotational direction of the impeller, and in that in the installed position of the fixedly attached diffusor this outlet is arranged in the upper region of the main body, in particular approximately in the 12 o'clock position thereof. This specific construction of the diffusor is, in particular, advantageous when starting up and/or starting the pump of the liquid heating pump if, during the stoppage phase of the impeller thereof, air is located in an upper cavity of the housing of the liquid heating pump. When starting up the impeller, liquid is then conveyed via this outlet without an inadmissibly long dwell time into the upper region of the diffusor and/or pressure chamber, and at the same time any air which is present there is forced to the discharge port and conveyed out of said pipe.

It is particularly advantageous according to an advantageous development of the invention if the respective guide blade portion axially protruding from the front wall of the main body into the impeller chamber, preferably extending in an arcuate, preferably spiral portion-shaped manner, is substantially connected, in particular substantially continuously connected, via a connecting portion, in particular integrally formed thereon, to the downstream radially protruding guide blade portion assigned thereto on the axial outer casing side, viewed in the rotational direction of the impeller, and extending preferably in a helical manner, in order to form a combined guide blade. This combined guide blade permits in terms of flow technology an even further improved path for the liquid from the peripheral liquid ejection region of the impeller in the impeller chamber into the diffusor and/or pressure chamber and through said diffusor and/or pressure chamber.

Expediently, the connecting portion extends along an outer peripheral portion of the front wall of the main body facing the impeller chamber. In this case, the connecting portion preferably comprises an axially protruding, in particular circular arc portion-like projecting portion and additionally a projecting portion protruding radially, in particular in a helical manner, on the axial front face thereof. The radially protruding projecting portion acts in this case in the axial direction as a barrier and/or obstacle which in the axial direction prevents an air bubble from the diffusor and/or pressure chamber from flowing back in the axial direction into the impeller chamber and thus ultimately into the center of the impeller chamber, when the liquid heating pump operates in pumping mode. The axially protruding projecting portion serves as an extension of the radial outer end portion of the axially protruding guide blade portion of the combined guide blade and preferably permits a continuous transition into the radially protruding guide blade portion on the axial outer casing side, assigned thereto. To this end, it may in particular be advantageous if the axially protruding projecting portion has an axial extent and/or dimension which reduces, in particular continuously, from its initial portion connected to the axially protruding guide blade portion, as far as its end connected to the radially protruding guide blade portion on the axial outer casing side. Additionally, the axially protruding projecting portion in the impeller chamber acts counter to the radial ejection direction of the impeller as a barrier and/or obstacle which hinders or prevents an air bubble from flowing back from the diffusor and/or pressure chamber in the radial direction into the center of the impeller chamber when the liquid heating pump operates in pumping mode.

According to an advantageous development of the invention, the connecting portion connects the axially protruding guide blade portion on the front face with the radially protruding guide blade portion assigned thereto on the axial outer casing side, in particular integrally and/or in single material to form a continuous guide blade. Thus as a whole the diffusor may be produced in a simple manner.

Expediently, the respective axially protruding guide blade portion axially protruding from the front wall of the main body into the impeller chamber, extends in an arcuate manner, preferably in the manner of a circular arc portion or spiral portion, (viewed in a normal plane to which the rotational axis of the impeller is perpendicular) and then, viewed radially outwardly, transitions substantially continuously into an outer edge zone of the front wall of the main body by means of the connecting portion which is preferably integrally formed thereon, into the downstream radially protruding guide blade portion which is assigned thereto on the axial outer casing side and which preferably extends in a helical manner, viewed in the rotational direction of the impeller. The axially protruding projecting portion of the connecting portion in this case extends the guide blade portion, which axially protrudes on the front face, in particular, in the form of a circular arc portion. The radially protruding projecting portion of the connecting portion extends the radially protruding guide blade portion on the axial outer casing side, preferably coinciding with the path shape thereof, in particular a spiral path shape.

In particular, by means of the one or more combined guide blades the liquid is advantageously removed (when viewing the front wall of the main body provided with one or more axial guide blade portions) from the outer periphery of the rotating impeller and conveyed along a spiral portion-type guide path to the further radially outwardly arranged diffusor and/or pressure chamber and then, viewed spatially, moved forward in the axial direction, circulating in a helical manner around the main body through the diffusor and/or pressure chamber. In particular, the hydraulic efficiency of the liquid heating pump configured according to the invention and the aeration behavior thereof are improved further thereby.

According to an expedient development, when viewing the front wall of the main body facing the impeller chamber, the respective guide blade portion radially protruding on the axial outer casing of the main body of the diffusor and its upstream extension formed by the radially protruding projecting portion of the connecting portion, extends in an outer peripheral region of the main body in the gap between the radial outer end of a first axially protruding guide blade portion and the radial outer end of a second adjacent axially protruding guide blade portion, viewed in the rotational direction of the impeller. As a result, an effective barrier against the flow-back of air bubbles is ensured so that these air bubbles are not able to flow back from the diffusor and/or pressure chamber into the center of the impeller chamber when the liquid heating pump operates in pumping mode or is started again after a stoppage phase of the pumping mode.

In this connection it is particularly advantageous if, when viewed in the installed position of the diffusor, an axially protruding guide blade portion and its connecting portion for the radially protruding guide blade portion assigned thereto on the axial outer casing side are arranged in the upper region of the front wall of the main body facing the impeller chamber, such that they prevent any air bubble present above the main body in the diffusor and/or pressure chamber from flowing back inwardly in the direction of the center of the impeller chamber during the rotational operation of the impeller. As a result, a rapid aeration is also ensured after a stoppage phase, in particular when starting up, i.e. when starting, the impeller of the liquid heating pump according to the invention.

According to an advantageous development of the invention, when viewing the front wall of the main body facing the suction side of the impeller, the respective radially protruding guide blade portion on the axial outer casing of the main body of the diffusor and its extension on the upstream side extends through the radially protruding projecting portion of the connecting portion in an outer peripheral region of the main body in the gap between the radial outer end of a first axially protruding guide blade portion and the radial outer end of a second adjacent axially protruding guide blade portion, viewed in the rotational direction of the impeller. The radially protruding projecting portion of the connecting portion as a result produces an axial barrier for an air bubble which is located in the diffusor and/or pressure chamber on the downstream side of the connecting portion, so that the air bubble is prevented from flowing back into the impeller chamber during the rotational operation of the impeller. This results in excellent self-aeration behavior of the liquid heating pump according to the invention.

It may be advantageous, in particular, if the respective guide blade portion which axially protrudes on the front wall of the main body facing the impeller chamber and/or the suction side of the impeller terminates on the outer periphery of the main body in the peripheral position in which the leading radially protruding guide blade portion on the axial outer casing side, viewed in the rotational direction of the impeller, terminates on the axial outer casing of the main body, viewed downstream, with an axial spacing from the front wall of the main body of the diffusor facing the impeller chamber and/or the suction side of the impeller. This ensures that the diffusor may be produced in a simple manner by means of two tool parts and/or mold parts which are able to be moved toward one another and away from one another in a plastics injection-molding process and fault-free unmolding of the radially protruding and axially protruding guide blade portions (and the optionally present connecting portions thereof) on the main body of the diffusor is possible.

It may be optionally advantageous if the main body of the diffusor is fixed or attached to the housing of the centrally arranged suction channel. As a result, a reconstruction of the pump housing is avoided so that this pump housing may be used for a plurality of different types of liquid heating pumps. It is particularly simple if a tubular portion is provided, in particular integrally formed, on the main body of the diffusor on the inside, said tubular portion forming an axial partial portion, in particular end portion, of the centrally arranged suction channel. As a result, the diffusor may be constructed in a particularly simple manner in the flow path of the liquid heating pump according to the invention.

It has been shown after tests successfully carried out for mass production in household dishwashers, in particular, that a design of the liquid heating pump constructed according to the invention is advantageous in which the internal diameter of the diffusor and/or pressure chamber or the external diameter of the, in particular, circular cylindrical diffusor main body, the axial outer casing thereof forming an axially extending partial portion or the entire portion of the internal defining wall of the diffusor and/or pressure chamber, is between 5.5 cm and 6.5 cm, in particular equal to 6.2 cm, and the external diameter of the diffusor and/or pressure chamber, the outer defining wall thereof partially or entirely in particular being formed by the heating device, preferably a heating tube, is selected to be between 7 cm and 7.5 cm, in particular approximately equal to 7.3 cm. The external diameter of the impeller in this case is expediently selected to be between 3.8 and 4.4 cm, in particular approximately equal to 4.2 cm.

The main body of the diffusor of this tested liquid heating pump is configured as an elongated circular cylinder. Preferably, it has an axial length of between 2 cm and 4 cm. It has three combined guide blades corresponding to the above descriptions. Viewed in the peripheral direction, the guide blades are expediently in each case arranged offset to one another by 120°. In this case, the respective guide blade portion axially protruding on the front face preferably extends over a centering angle range of between 50° and 90°, viewed in the peripheral direction, its connecting portion preferably extends over a centering angle range of between 30° and 60°, viewed in the peripheral direction, and the radially protruding guide blade portion assigned thereto on the axial outer casing side, preferably extends over a centering angle range of between 50° and 90°.

When starting up the pumping mode of the liquid heating pump according to the invention, in order to prevent an air bubble, in particular, from flowing back from the 12 o'clock region of the diffusor and/or pressure chamber into the impeller chamber counter to the predetermined pump outflow direction, the diffusor in its fixedly installed position is expediently aligned so as to be oriented in its angular position, such that one of the three guide blade portions axially protruding on the front face, viewed in the polar coordinate system, extends in the angular range of between 10° and 90°, its connecting portion extends in the angular range of between 90° and 135° and the radially protruding guide blade portion assigned thereto on the axial outer casing side extends in the angular range of between 135° and 205°.

In this liquid heating pump a transit time of at most 6 seconds, in particular of between 3 seconds and 6 seconds, preferably of approximately 5 seconds, is advantageously possible for air bubbles suctioned via the suction channel. This transit time is advantageous in connection with the times to be maintained of the individual liquid-conducting partial wash cycles of the wash cycle of a dishwashing program of a household dishwasher to be performed.

In the liquid heating pump specified above, which has been successfully tested for mass production, the respective axially protruding guide blade portion expediently protrudes with an axial extent of between 3 mm and 8 mm, in particular approximately 5 mm, on the front wall of the main body into the impeller chamber. In the case of an impeller in which the liquid ejection region is located between the front and rear cover disk thereof, this corresponds approximately to the axial spacing thereof, by adding on the axial gap dimension between the front wall of the main body facing the impeller chamber and the front face of the impeller on the suction side.

The invention further relates to a household appliance which uses water, in particular a household dishwasher or household washing machine, with a liquid heating pump configured according to the invention.

Other developments of the invention are set forth in the subclaims. The advantageous embodiments and developments of the invention described above and/or reproduced in the subclaims—apart for example in the cases of clear dependencies or alternatives which may not be combined together—may be used individually or together in any combination.

BRIEF DESCRIPTION OF THE DRAWINGS

The invention and its advantageous embodiments and developments and the advantages thereof are described hereinafter in more detail with reference to drawings showing exemplary embodiments. In each case, in a schematic sketch.

DETAILED DESCRIPTION OF EXEMPLARY EMBODIMENTS OF THE PRESENT INVENTION

Figure 1:
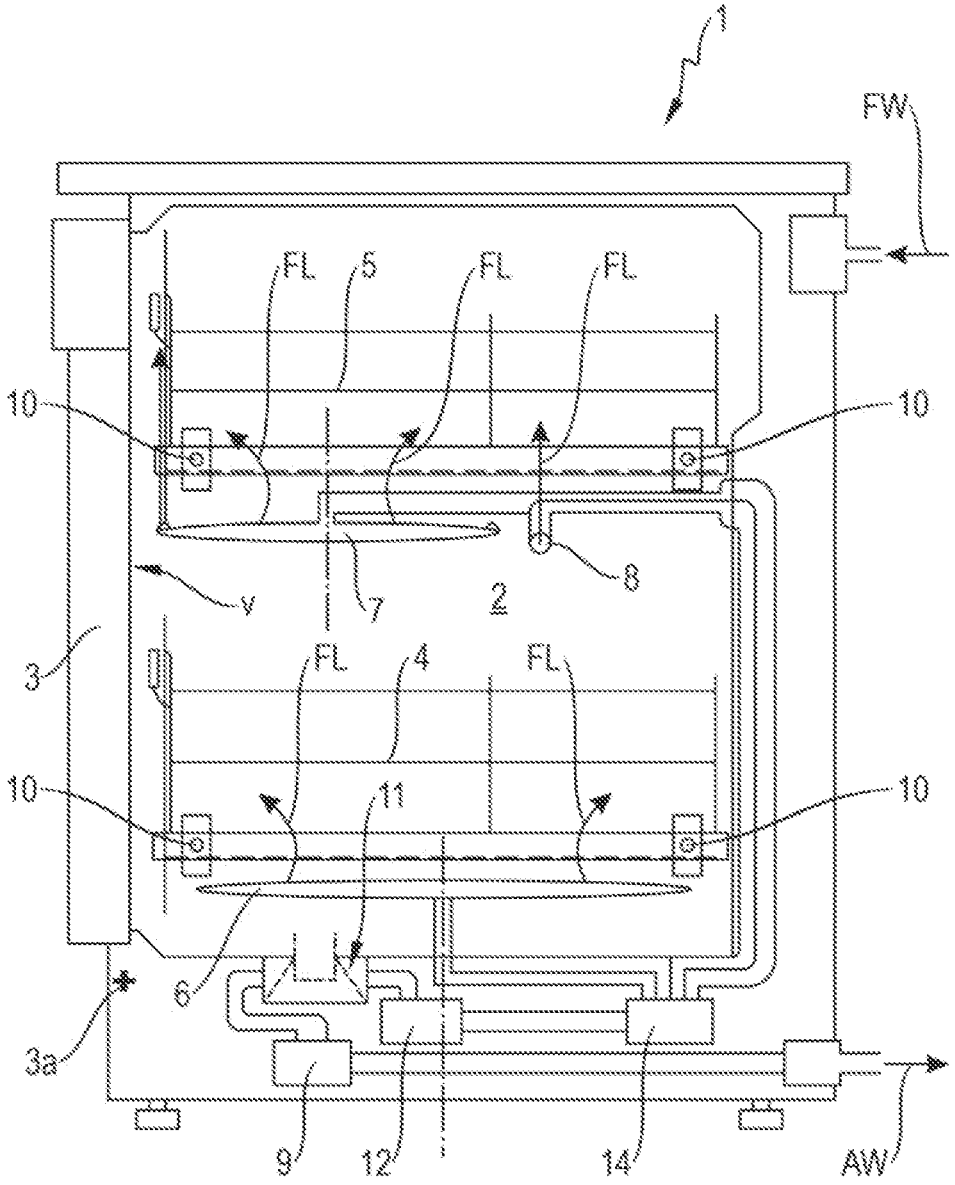
FIG. 1 shows in a schematic view a household dishwasher with an advantageous variant of a liquid heating pump configured according to the invention.

In FIGS. 1-8, parts corresponding to one another are provided with the same reference numerals. In this case only those components of a household appliance which uses liquid and/or water which are required for understanding the invention are provided and described with reference numerals.

The construction principle according to the invention of a liquid heating pump which is installed in a household dishwasher is described hereinafter. This liquid heating pump may optionally also be provided in other household appliances which use liquids, such as for example in a washing machine, as a component of the washing unit and/or liquid circulation circuit thereof.

FIG. 1 shows in a schematic view a household dishwasher 1 viewed from the side. Said dishwasher comprises a washing container 2 for receiving items to be washed, such as crockery, pans, cutlery, glasses, cooking utensils and the like to be cleaned by liquid and then to be dried. The washing container 2 preferably comprises a substantially rectangular contour (viewed from above) with a front face V facing a user in the operating position. A loading opening which is accessible from the front is present here. This is able to be closed by a front door 3. The door 3 is shown in FIG. 1 in the closed position and, for example, is able to be pivoted up about a horizontal axis 3*a*. Naturally the loading opening may also be provided at a different point of the washing container, such as for example in the upper face thereof, and is able to be closed and opened by a closure element, such as for example a flap.

In the interior of the washing container 2, one or more receiver containers, such as for example washing baskets 4, 5 for receiving or retaining items to be washed are provided. Here in the exemplary embodiment of FIG. 1 by way of example just two washing baskets and/or crockery baskets 4, 5 are provided on top of one another. The number of washing baskets may be varied depending on the extent and type of household dishwasher 1. Also a so-called cutlery drawer may additionally be provided. These crockery baskets 4, 5 are able to be subjected via one or more spray devices 6, 7, 8 to fresh water FW and/or to circulating water, depending on the partial wash cycle of the wash cycle to be carried out of a dishwashing program, in each case cleaning agent, rinsing agent, and/or other aids being able to be added thereto, i.e. so-called washing liquor liquid and/or washing liquor, and thus generally expressed by washing liquid FL which substantially contains water.

In each case, preferably rotatable spray arms are provided in the interior of the washing container 2 as one or more spray devices. Here in the exemplary embodiment of FIG. 1, for example, two rotatable spray arms 6, 7 are accommodated in the washing container 2, which subject the items to be washed in the crockery baskets 4, 5 in particular to an upwardly oriented spray component. In this case, the lower spray arm 6 is arranged below the lower crockery basket 4. The upper spray arm 7 is arranged below the upper crockery basket 5. Additionally or independently from the two rotatable spray arms 6, 7 other types of spray devices may also be provided. Thus, for example, one or more individual spray nozzles may also be accommodated in a fixed manner in the washing container 2. In the exemplary embodiment of FIG. 1, in addition to the upper rotatable spray arm 7 a spray device 8 is arranged below the upper crockery basket 5 and assigned thereto. It comprises one or more individual nozzles which also convey the liquid FL with an upwardly oriented component to the items to be washed in the upper crockery basket 5. Alternatively, it is also possible to subject the items to be washed to a downwardly oriented spray component. Thus, for example, from the upper spray arm 7 liquid spray jets may also be oriented downwardly onto the items to be washed in the lower crockery basket 4. Also other spray devices are alternatively or additionally possible. Thus on the top wall of the washing container 2 optionally a so-called top spray may be provided, which has been omitted here in FIG. 1 for the sake of illustrative simplicity.

Moreover, the washing baskets 4, 5 may be displaceable to the front, for example on rollers 10, in order for the user to reach an access position in which the user is able to load and unload the washing baskets 4, 5 comfortably. Lateral rails are provided in the washing container 2 as tracks for the rollers 10. Optionally, pull and push handles may be provided on the front edge planes of the washing baskets 4, 5 for simplifying the insertion and extension of the washing baskets 4, 5.

The fresh water FW and/or the circulating washing liquor mixed with cleaning agent, rinse agent, additives and/or dirt from the items to be washed, i.e. in general terms the treatment liquid FL which substantially contains water, passes downwardly, after its distribution in the washing container 2 by being sprayed onto the items to be washed, to a collecting region and/or pump sump 11 which is preferably arranged so as to be recessed in the floor of the washing container 2. Here the liquid passes through a filter unit which is also indicated in dashed lines in FIG. 1. From this collecting region the liquid is conducted in the spraying operation and/or circulating operation of the spray devices to a liquid heating pump 12 fluidically connected to the collecting region 11 and/or suctioned therefrom. The liquid heating pump 12 comprises a circulating pump and in combination therewith additionally a heating device. By means of the circulating pump of the liquid heating pump 12 the liquid is pumped to a distributor unit 14, fluidically connected thereto, in particular a water distribution device, and conducted from there to the spray devices 6, 7, 8. Optionally the distributor unit may also be dispensed with. For pumping out the liquid from the washing container 2 this liquid is pumped out by means of a drainage pump 9 as waste water AW from the washing container 2.

Figure 2:
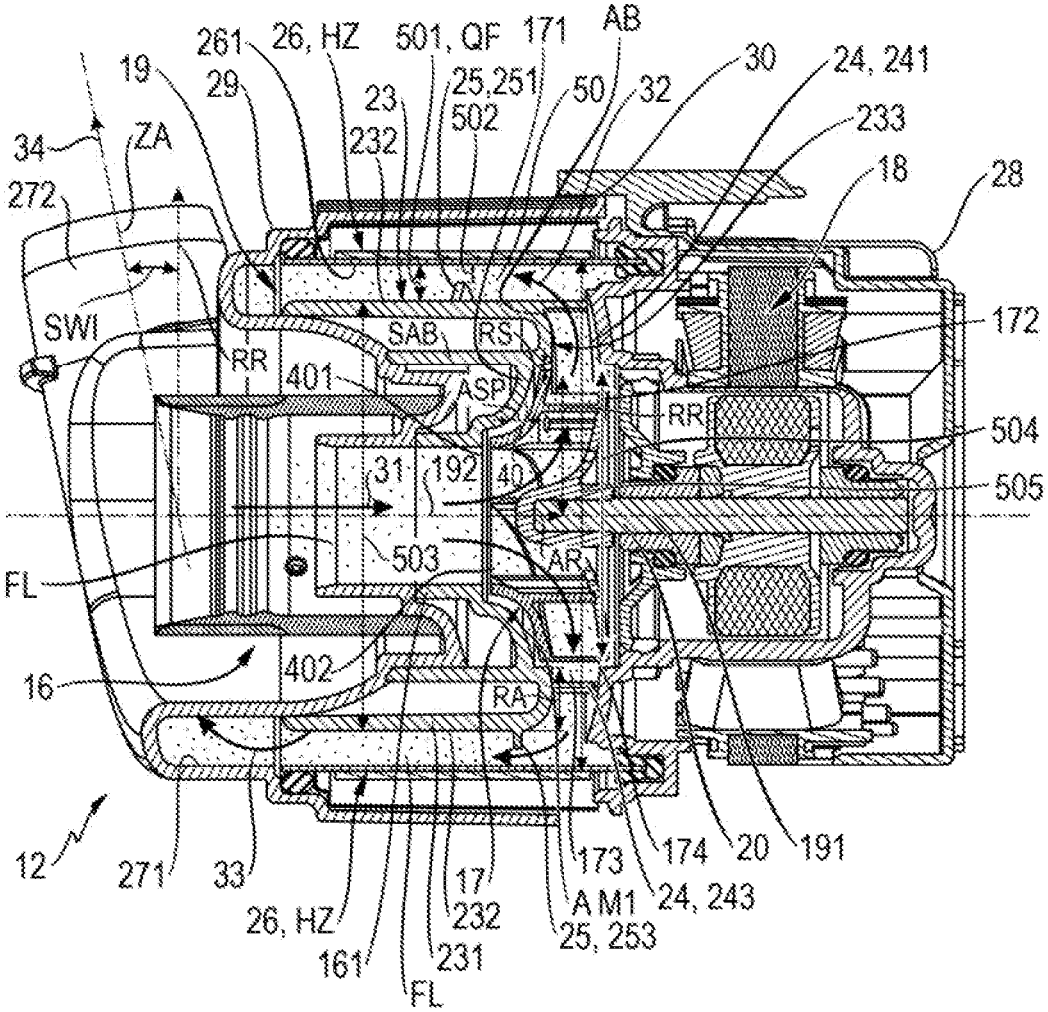
FIG. 2 shows in a schematic longitudinal sectional view the liquid heating pump of FIG. 1.
Figure 3:
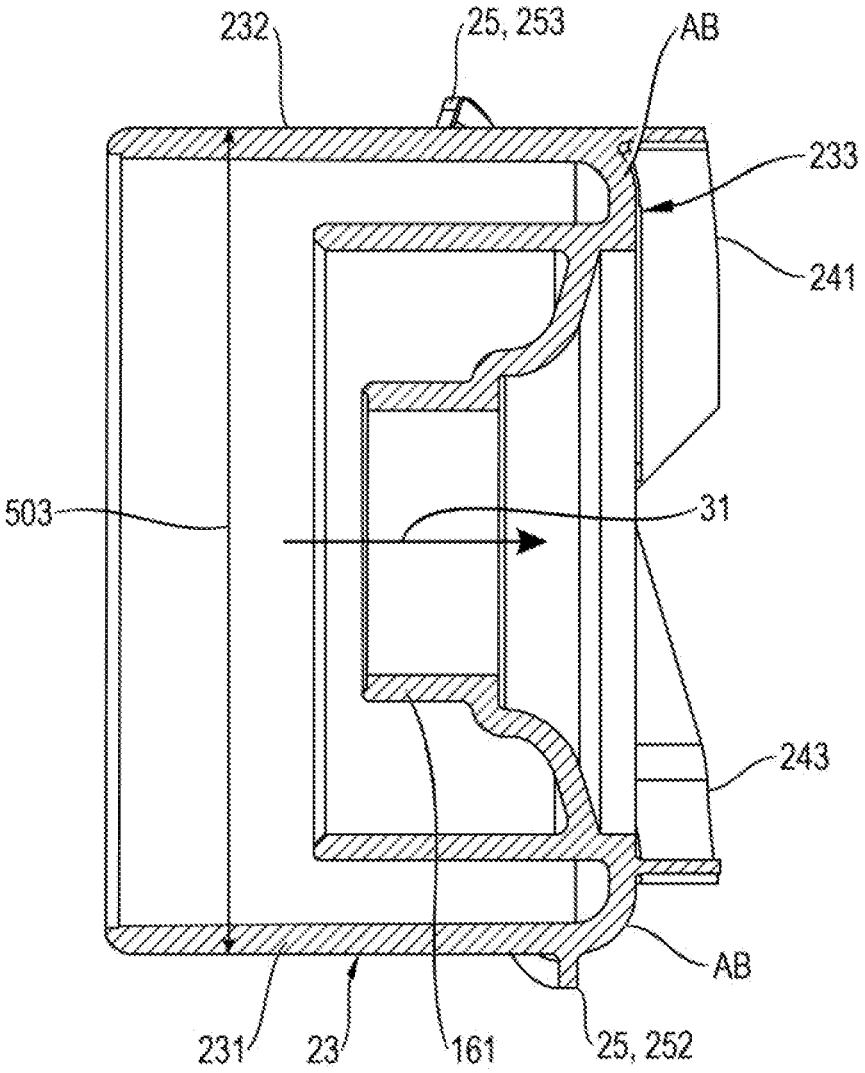
FIG. 3 shows schematically in longitudinal section the diffusor of the liquid heating pump of FIG. 2.

FIG. 2 shows in a schematic longitudinal sectional view a first advantageous exemplary embodiment of a liquid heating pump 12 configured according to the invention. This liquid heating pump comprises two main subassemblies: a first housing part 28 with a drive unit 18 accommodated therein, in particular an electric motor accommodated therein, and a second housing part 29 with a hydraulic unit 19 accommodated therein. In the first housing part 28 the electric motor 18 is mounted such that its drive shaft 20 is substantially oriented in the axial direction AR. The axial direction AR may preferably extend, as here in the exemplary embodiment, substantially horizontally when the liquid heating pump 12 is installed below the floor of the washing container 2 in the floor subassembly of the household dishwasher 1. Alternatively, it may naturally also extend in the installed state so as to deviate from the horizontal, such as for example at an angle of between 10° and 70° to the horizontal. The first housing part 28 is substantially configured to be hollow-cylindrical. The drive shaft 20 protrudes from the front wall of the first housing part 28 facing the hydraulic unit 19 with an end portion. On this end portion of the drive shaft 20 facing the hydraulic unit 19, an impeller 17 is attached fixedly to the front face. This impeller is configured to be substantially circular in cross section, i.e. in a cutting plane to which the rotational axis 191 of the impeller extends in a perpendicular manner. The second housing part 29 with the hydraulic unit 19 accommodated therein forms in the assembled state of the liquid heating pump 12 an axial extension of the first housing unit 28. In this case, the second housing part 29 is also configured to be substantially hollow-cylindrical. The first housing unit 28 and the second housing unit 29 are joined together via preferably releasable coupling means and/or fastening means 30 to form a closed compact pump housing in the axial direction. Both the first housing part 28 with the drive unit 18 accommodated therein and the second housing part 29 with the hydraulic unit 19 accommodated therein are in each case preferably configured to be substantially rotationally symmetrical relative to the rotational axis 191 of the drive shaft 20 and/or the imaginary extension thereof as a central axis of the liquid pump 12.

The hydraulic unit 19 comprises a centrally arranged suction channel 16 for suctioning the liquid FL in an axial suction direction 31 and for supplying the suctioned liquid FL into an impeller chamber 40 arranged axially downstream. The liquid FL is symbolized in FIG. 2 by dots. The central axis 192 of the suction channel 16 in this case is oriented so as to be aligned with the rotational axis and/or central axis 191 of the drive shaft 20. The suction channel 16 is preferably formed by one or more circular cylindrical tubular portions which in each case are arranged concentrically to the central axis 192 of the liquid heating pump 12. If the two housing parts 28 and 29 in the axial direction AR, i.e. relative to their central axes 191, 192, are combined so as to be aligned with one another, the impeller chamber 40 viewed in the suction direction 31, is defined by a rear wall which is formed by one or more wall parts on the front face of the first housing part 28 on which the drive shaft 191 with the impeller 17 fastened at the end thereof protrudes into the impeller chamber 40 counter to the suction direction 31. Moreover, viewed in the suction direction 31, the impeller chamber 40 is defined by a front wall which is formed by one or more wall parts on the front wall of the second housing part 29 which faces the first housing part 28. The suction channel 6 discharges into this front wall of the impeller chamber 40 with its centrally arranged circular outlet opening 401, viewed in cross section, i.e. its central axis 192 is oriented so as to be aligned with the rotational axis 191 of the drive shaft 20. The axial width of the impeller chamber 40 is selected such that between the front wall facing the impeller 17 of the tubular, in particular circular cylindrical, suction channel 16 and the front wall on the suction side of the impeller 17, an axial gap ASP and a radial gap RS remain in order to ensure the free rotatability of the impeller 17. Expediently, the axial gap ASP has an axial width of between 0.5 mm and 1.5 mm and the radial gap RS has an axial width of between 0.5 mm and 1.5 mm.

The impeller here in the exemplary embodiment is preferably configured as a bladed impeller. Viewed in the axial suction direction 31 it has a front cover disk 171 facing toward the suction channel 16 and an opposing rear cover disk 172 in the axial spacing facing the first housing part 28. The blades 174 of the impeller 17 extend between the two cover disks 171, 172. Both the front cover disk 171 and the rear cover disk 172 in each case are curved, viewed from the suction channel 16, in the direction opposing the axial suction direction 31, i.e. to the rear. In particular, in each case they are configured to be concave. In this case a centrally arranged inlet opening 402 which is substantially aligned with the outlet opening 401 of the outlet channel 16 is provided in the front cover disk 171. The rear cover disk 172, however, is designed to be closed. The impeller 17 is attached to the drive shaft 20 such that it is arranged with its rear cover disk 172 in a receiving recess which is recessed in the axial direction AR in the rear wall of the impeller chamber 40 with a predetermined axial gap from the rear wall and thus is freely rotatable, i.e. not in abutment. The curvature of the rear cover disk 172 is extended and/or increased by the wall portion of the rear wall of the impeller chamber surrounding the cover disk, viewed further radially outwardly, substantially without axial offset. Correspondingly, the wall part of the front wall of the impeller chamber 40 surrounding the front cover disk 171 further outwardly, viewed radially, extends the curvature and/or convexity of the inner face of the front cover disk 171 through which liquid flows, substantially without axial offset.

The impeller blades 174 in each case bridge the axial gap spacing between the two axially spaced-apart opposing cover disks 171, 172 and are attached, in particular fastened, to the inner walls thereof facing one another. A liquid through-passage is respectively present between two impeller blades 174 adjacent in the peripheral direction. The blades 174 of the impeller 17 in each case are curved counter to the rotational direction 60 of the impeller 17. The blades extend in each case in the form of a circular arc portion or spiral portion opening outwardly, the radial internal end thereof starting approximately at the peripheral circle of the inlet opening 402 of the front cover disk 171 and the radial outer end thereof approximately ending at the outer periphery and/or external diameter of the front and rear cover disk 171, 172. The respective blade of the impeller is preferably spring-loaded relative to the radial direction (viewed in a normal plane to which the rotational axis 191 extends in a perpendicular manner). If the impeller 17 is driven rotatably by means of the drive unit 18 via the drive shaft 20, the liquid FL present in the impeller chamber 40 is forced away from the center of the impeller 17 outwardly with a radial and circular and/or azimuthal speed component into the radial outer region of the impeller chamber 40. As a result, a greater pressure prevails on the radial outer periphery of the impeller in the impeller chamber 40 than in the center thereof. In this manner, the impeller 40 suctions liquid via the suction channel 16 from the pump sump and/or collecting region 11. The rear curvature of the front cover disk 171 and the rear cover disk 172 and the rear wall assists the liquid conveyed by the impeller to pass through a curved path and to be deflected in the opposing direction to the suction direction 31. This approximate 180° deflection is illustrated in FIG. 2 by the directional arrow 32. In addition to or independently from the geometric shape of the impeller, optionally—as here in the exemplary embodiment of FIG. 2—it may be expedient if the rear wall surface of the impeller chamber and/or the initial portion of the diffusor and/or pressure chamber which, viewed in the flow direction, is immediately downstream of the impeller chamber, also contributes to deflecting the conveyed liquid coming from the axial suction direction 31 by approximately 180° in the opposing direction, i.e. in the axial outflow direction.

In general terms, the impeller has a liquid ejection region around its outer peripheral edge, from which in pumping mode and/or rotational operation (i.e. with the rotating impeller) the liquid is thrown outwardly from the through-passages between its blades. This peripheral liquid ejection region in FIGS. 1-8 is in each case denoted by 173. In the case of the impeller 17 of FIGS. 1-8, the peripheral liquid ejection region is located between the front and the rear cover disks 171, 172.

The liquid FL conveyed in this manner from the impeller 17, then flows into an axially downstream diffusor and/or pressure chamber 50 viewed counter to the suction direction 31. This diffusor and/or pressure chamber is arranged at least along a partial portion of the suction channel 16 outwardly around this suction channel. The diffusor and/or pressure chamber surrounds the suction channel 16 substantially concentrically and/or coaxially. Viewed in cross section, i.e. in a cutting plane transversely to the axial longitudinal extent of the liquid heating pump 12 to which the rotational axis 191 substantially extends in a perpendicular manner, the diffusor and/or pressure chamber 50 is configured to be substantially circular. A diffusor and/or a flow conditioning device 23 which converts the kinetic energy induced by the rotational movement of the impeller 17 into the liquid flow partially into dynamic pressure, is provided in a stationary manner in the diffusor and/or pressure chamber 50. It has a longitudinally extended main body 231 which forms an axially extending partial portion of the internal defining wall or the entire internal defining wall of the diffusor and/or pressure chamber 50. It may be expedient if—as here in the exemplary embodiment of FIG. 2—a tubular portion is provided, in particular integrally formed, on the main body 231 of the diffusor 23 on the inner face, said tubular portion forming an axial partial portion, preferably an end portion assigned to the impeller 17, of the centrally arranged suction channel 16. Additionally or independently thereof, it may be advantageous if the main body 231 of the diffusor 23 is supported on the housing of the centrally arranged suction channel 16 or attached there. In the exemplary embodiment of FIG. 2, the main body 231 is additionally fixed or attached via an axially extending tubular support portion SAB to the housing part 29.

The main body 231 preferably has an elongated substantially circular cylindrical tube, the front wall thereof facing the impeller 17 being configured as a wall around the outlet opening 401 of the suction channel 16 and, viewed in the axial suction direction 31, forming the front defining wall of the impeller chamber 30. This front wall has a circular receiving recess AM1 arranged around the outlet opening of the suction channel 16, for the front cover disk 171 of the impeller 17. The internal contour of this receiving recess in this case substantially corresponds to the outer contour on the suction side of the front cover disk 171. Its axial depth is selected such that the impeller 17 penetrates therein with its front cover disk 171, such that on the inner face of the impeller, a substantially flush continuous transition is produced between the inner wall of the front cover disk 171 and the front surface edge which protrudes relative to the receiving recess AM1 in the direction of the impeller 17 located further radially outwardly, as far as the radial gap RS which remains free, for the free running of the impeller.

The radial outer edge zone of the front wall 233 of the main body 231 facing the suction side of the impeller 17 expediently transitions into the axial longitudinal extent of the axial outer casing 232 of the circular cylindrical main body 231 in the form of a rounded portion AB. This rounded portion AB is also curved to the rear from the suction channel 16, viewed in the axial suction direction 31, in particular in a concave manner. By this rounded portion AB on the front face in the transition from the front wall 233 of the main body 231 into the axial outer casing 232, in particular into the circular cylindrical casing surface, of the main body 231, undesired directional influences, eddy losses or deceleration of the liquid FL ejected from the impeller 17 are substantially prevented. In particular by this rounded portion AB between the radial outer edge zone of the front wall 233 of the main body 231 and the circular cylindrical axial outer casing 232, the reverse path of the liquid flow from the axial suction direction 31 in the 180° opposing direction is promoted. Alternatively to the rounded portion, optionally a recess or groove may be provided on the radial outer edge zone of the front wall 233 of the main body 231 facing the suction side of the impeller 17 as a transition zone between the front wall 233 and the axial outer casing 232.

A heating device 26 which serves for heating the liquid FL conveyed by the impeller 17 is assigned to the diffusor and/or pressure chamber 50. Preferably, the heating device forms a preferably axially extending partial portion or the preferably axially extending entire portion of the outer defining wall of the diffusor and/or pressure chamber 50. As a heating device 26 advantageously a preferably circular cylindrical heating tube HZ is provided extending in the axial direction AR. This heating tube HZ surrounds the circular cylindrical main body 231 from outside substantially concentrically and/or coaxially along an axial partial length or as here in the exemplary embodiment of FIG. 2 substantially along the entire axial length of the main body 231 with a predetermined radial gap spacing 501, such that the diffusor and/or pressure chamber 50 between the axial outer casing 232 of the circular cylindrical main body 231 and the axial inner casing 261 of the circular cylindrical heating tube HZ, viewed in cross section, i.e. viewed in a normal plane to which the rotational axis extends in a perpendicular manner, is configured in the shape of an annular gap.

In the liquid heating pump constructed according to the principle according to the invention which has been successfully tested for mass production in household dishwashers, the radial gap spacing 501 of the diffusor and/or pressure chamber 50 between the axial outer casing 232 of the preferably circular cylindrical main body 231 and the smooth axial inner casing 261 of the preferably circular cylindrical heating tube HZ arranged further radially outwardly relative thereto, is expediently between 3 mm and 8 mm, in particular approximately 5.5 mm. This is a clear reduction, in particular approximately a halving, of the radial gap dimension between the axial outer casing 232 of the main body 231 and the axial inner casing surface 261 of the heating tube HZ through which liquid flows, relative to liquid heating pumps used hitherto in household dishwashers.

Expediently, the in particular circular cylindrical main body of the diffusor in the liquid heating pump configured according to the invention is preferably expanded and/or increased such that the external diameter 503 of its axial outer casing 232 is at least equal to 80%, in particular between 80% and 90%, preferably approximately equal to 86% of the external diameter 505 of the diffusor and/or pressure chamber 50 and/or the external diameter 505 of the outer defining wall 261 of the diffusor and/or pressure chamber 50. This leads to a reduction in the annular gap-shaped through-passage surface in the diffusor and/or pressure chamber, such that with an equal volumetric flow of liquid FL provided by the impeller 17, the flow speed through the diffusor and/or pressure chamber 50 is increased, such that in a reliable manner sufficient heat is dissipated by the liquid FL conveyed by the rotating impeller from the heating device 26, as may be ensured in this case in the exemplary embodiment from the axial inner casing surface 261 of the circular cylindrical heating tube HZ, through which the liquid flows. Additionally, the dead space volume in the pump housing for the liquid to be conveyed may be reduced. The reduction in the annular cross-sectional passage surface in the diffusor and/or pressure chamber 50 is associated with an improved displacement effect for the liquid flowing through. This results in a reduction in the total quantity of liquid circulating in the liquid heating pump according to the invention. As a result, the so-called transfer of dirty liquor may be further reduced, which may occur when changing the washing bath, i.e. when the washing bath quantity used for a water-conducting partial wash cycle of a dishwasher program is pumped out partially or entirely by means of the drainage pump from the washing container of the dishwasher and fresh water for the next water-conducting partial wash cycle of this dishwasher program, for a further washing bath, is introduced into the washing container. Since the circulating pump of the liquid heating pump during the drainage process of the previously completed partial wash cycle is generally switched off, dirty washing liquid used from this previous water-conducting partial wash cycle remains therein and only when the liquid heating pump is started up again in the following partial wash cycle is this quantity of already used washing water pumped out of the liquid heating pump from the pump housing and in the course of the partial wash cycle introduced via the one or more spray devices into the washing container. Due to the reduced dead space volume in the liquid heating pump according to the invention also less water may be used overall per washing bath. By the reduction of the circular passage cross section of the diffusor and/or pressure chamber additionally the flow speed of the liquid flowing through is increased. As a result, an improved dissipation of the heating power provided by the heating device to the liquid flowing through the diffusor and/or pressure chamber is ensured. This is associated with a reduced temperature load of the heating device 26. The surface of the heating device 26 in contact with the conveyed liquid, in this case in the exemplary embodiment of FIG. 2 the inner wall surface 261 of the preferably circular cylindrical heating tube HZ, tends therefore less to the formation of limescale deposits which impair the heat transfer from the heating device 26 to the liquid FL, here from the inner wall surface 261 of the heating tube HZ to the liquid flowing through said heating tube, and associated therewith tends less to the formation of so-called hot spots, i.e. local overheating points which may lead to thermal and/or electrical damage of the heating device.

Correspondingly, for the diffusor and/or pressure chamber in the exemplary embodiment of FIG. 2, the diameter 505 of the impeller chamber 40 is also increased relative to the external diameter 504 of the impeller 17. Here it is selected to be approximately equal to the diameter of the outer defining wall of the diffusor and/or pressure chamber. As a result, an initial portion of the heating device 26 may even be accommodated in the impeller chamber 40, and then extend further into the diffusor and/or pressure chamber 50 arranged downstream. In particular, an initial portion of the heating device 26 forms a partial portion or the entire portion of the outer defining wall of the impeller chamber. In this manner, the axial length of such an advantageously configured liquid heating pump may be shortened relative to previous liquid heating pumps, so that (in comparison with a construction in which the initial portion of the heating device only starts in the diffusor and/or pressure chamber) less installation space is required in the floor subassembly of the dishwasher 1 of FIG. 1.

In summary, in the exemplary embodiment here, the heating device is expediently provided by a heating tube HZ which forms the outer defining wall 261 of the diffusor and/or pressure chamber 50 along a partial length or the entire length of the axial extent thereof. The heating tube HZ may, in particular, comprise, for example, a circular cylindrical metal tube, the conveyed liquid flowing over the smooth inner casing surface thereof and/or inner wall surface 261 thereof. On its outer casing surface, remote from the diffusor and/or pressure chamber 50, it preferably has an electrical insulating layer with heat conductors attached thereto on the outer face. The heat conductors may expediently be covered outwardly by an additional covering layer, in particular an electrical insulating layer. The electrical insulating layer, the heat conductor tracks and/or the covering layer may, in particular, be applied by a thick film technique or by a physical gas phase deposition method, such as for example PVD (physical vapor deposition) method. Naturally, other types of heating tubes are also possible.

In a liquid heating pump constructed according to the principle according to the invention, such as for example 12, which has been tested successfully for mass production in household dishwashers, the heating device 26 for heating up the washing liquid to a desired temperature in the respective partial wash cycle, such as for example during a cleaning cycle or rinsing cycle, of a dishwashing program to be carried out, preferably provides an electrical surface thermal load of between 30 W/cm$^2$ and 50 W/cm$^2$. For the heat dissipation thereof, by means of the liquid FL conveyed in the pumping mode, in this case the cross-sectional passage surface QF of the annular gap-shaped diffusor and/or pressure chamber 50, viewed in cross section, is advantageously selected to be between 8 cm$^2$ and 20 cm$^2$, in particular approximately 12 cm$^2$. This dimensioning is advantageous, in particular, if the impeller—in particular with an external diameter of approximately 4.2 cm—expediently revolves at between 3800 and 4800 rpm, in particular 4200 rpm in pumping mode. In this case the external diameter of the impeller, in particular, is selected to be between 3.8 and 4.5 cm, preferably approximately 4.2 cm. The circular cylindrical diffusor main body of this successfully tested liquid heating pump expediently has an external diameter of approximately 6.2 cm and the heating tube an internal diameter of approximately 7.3 cm.

In summary, the liquid heating pump 12 comprises a centrally arranged suction channel 16 for suctioning the liquid FL in an axial suction direction 31 and for supplying the suctioned liquid into an impeller chamber 40 arranged axially downstream. In the impeller chamber 40 an impeller 17 is provided to be rotatably drivable, in order to convey the liquid into a diffusor and/or pressure chamber 50 arranged axially downstream, viewed counter to the suction direction 31. This diffusor and/or pressure chamber is preferably coaxially arranged around an axial partial portion or the axial entire portion of the suction channel 16 on the outside. A stationary diffusor 23 is assigned to the diffusor and/or pressure chamber 50. This diffusor has an, in particular, circular cylindrical main body 231, the front wall 233 thereof facing the impeller 17 forming a defining wall of the impeller chamber 40 on the suction side, i.e. on the front, and the axial outer casing 232 thereof forming, in particular, the axially extending partial portion or the entire portion of the inner defining wall of the diffusor and/or pressure chamber 50 extending, in particular, axially. Additionally, the heating device assigned to the diffusor and/or pressure chamber 50 for heating the conveyed liquid FL expediently forms at least one, in particular axially extending, partial portion or the entire portion of the outer defining wall 261 of the diffusor and/or pressure chamber 50, in particular extending axially.

Downstream of the diffusor and/or pressure chamber 50 concentrically arranged around the suction channel 16, viewed counter to the suction direction 31, i.e. in the axial outflow direction, is a housing outlet 271 preferably extending with an axial extent in a helical and/or spiral-shaped manner with an assigned tubular discharge port 272, branching off laterally, in particular approximately tangentially on the outlet side for ejecting the liquid FL. The outflow direction of the conveyed liquid, facing upwardly in the exemplary embodiment of FIG. 2, is indicated by a directional arrow 34. The central axis ZA of the discharge port 272 is positioned obliquely relative to the radial direction RR counter to the axial suction direction 31, i.e. in the outflow direction, preferably by an acute angle SWI, in particular between 5° and 20°, preferably approximately 10°. Naturally, if required it is possible to provide to the housing outlet 271 and/or the discharge port 272 a path which deviates from the axial spiral housing or a geometric shape which deviates therefrom.

The liquid heating pump 12 is expediently installed in a bottom support and/or a floor subassembly below the floor of the washing container 2, such that the discharge port 272 protrudes from the second housing part 29 upwardly in the direction of the floor of the washing container 2. The liquid heating pump 12 is thus installed with a rotational axis extending substantially in the horizontal and/or in the axial direction of its drive shaft and thus is installed in the dishwasher 1 so as to be located in the floor subassembly below the floor of the washing container 2. As the outlet 271 is preferably configured with the discharge port 272 as an outwardly opening spiral portion which is integrally formed on the second housing part 29 on the front wall remote from the first housing part 28, and opposing the cross-sectional plane to which the rotational axis 191 extends in a perpendicular manner, and extends counter to the axial suction direction 31 and/or counter to the direction of gravity obliquely by an acute angle, the liquid flow which preferably moves in the diffusor and/or pressure chamber 50 in the form of a helix and/or helical line migrating counter to the suction direction 31 in the axial outflow direction toward the discharge port may be conveyed out of said discharge port by continuing this flow movement from the discharge port 272. As a result, hydraulic losses are substantially prevented, i.e. the hydraulic efficiency of the liquid heating pump is improved. In FIG. 2 this helical flow path of the liquid FL in the diffusor and/or pressure chamber and downstream thereof into the discharge port 272 is indicated by the flow arrow 33.

Within the scope of the invention the hydraulic-mechanical efficiency, in particular, encompasses the pressure losses and frictional losses in the components of the liquid heating pump. The volumetric efficiency thereof, however, is determined, in particular, by any leakage losses which are present.

In contrast or alternatively to the advantageous spatial-geometric shape of the impeller chamber and/or the impeller arranged therein of the exemplary embodiment of FIG. 2, optionally other designs of the impeller chamber and/or the impeller may also be expedient, provided these ensure in each case that liquid from the pump sump 11 is suctioned through the suction channel 16 in the axial suction direction 31 into the impeller chamber 40 and is able to be deflected there by approximately 180° in the opposing direction into the diffusor and/or pressure chamber 50 arranged downstream, and at the same time the liquid in the impeller chamber may be provided with a sufficient speed component by the rotational movement of the impeller in the radial direction and in the circular direction. Thus, for example, it may also be sufficient to accommodate an open impeller in the impeller chamber on the suction side. In particular, it may be expedient if, instead of simply curved blades, the impeller comprises three-dimensionally curved blades, i.e. so-called 3D blades. Advantageously—as here in the exemplary embodiment of FIG. 2—a so-called half-axial, half-radial impeller is used. Instead of this, a so-called radial impeller may also be accommodated in the impeller chamber 40. In the exemplary embodiment of FIG. 2 a so-called closed impeller is provided in which the impeller blades on both sides are connected to one respective disk. This increases the hydraulic efficiency and stabilizes the impeller.

Generally, the problem occurs in impellers, the rotating impeller blades thereof setting the liquid in rotation, i.e. subjecting the liquid to a circular speed component, that by means of centrifugal forces air collects in the center of the impeller chamber and/or around the hub 175 of the impeller and the liquid through-passages between the blades thereof "block up". If air collects in the center of the impeller chamber during rotational operation of the impeller, the impeller is no longer able to create sufficient pressure in order to suction liquid through the suction channel from the pump sump and to convey the liquid through the impeller chamber and the downstream diffusor and/or pressure chamber out of the discharge port on the outlet side.

Figure 4:
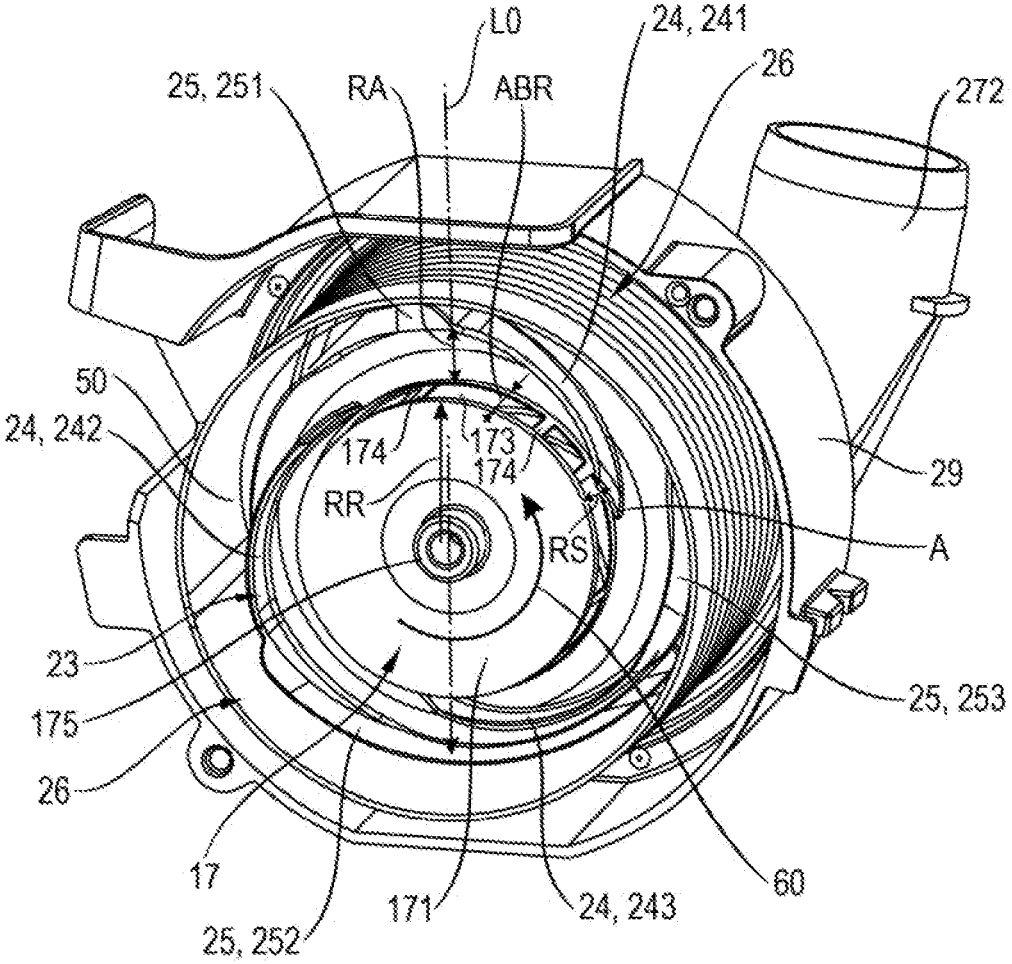
FIG. 4 shows schematically in a perspective view the liquid heating pump of FIG. 2 in the open state in which its first housing part with the drive unit contained therein is omitted, wherein the viewing direction is toward the front wall of its second housing part facing the first housing part with the hydraulic unit contained therein.
Figure 5:
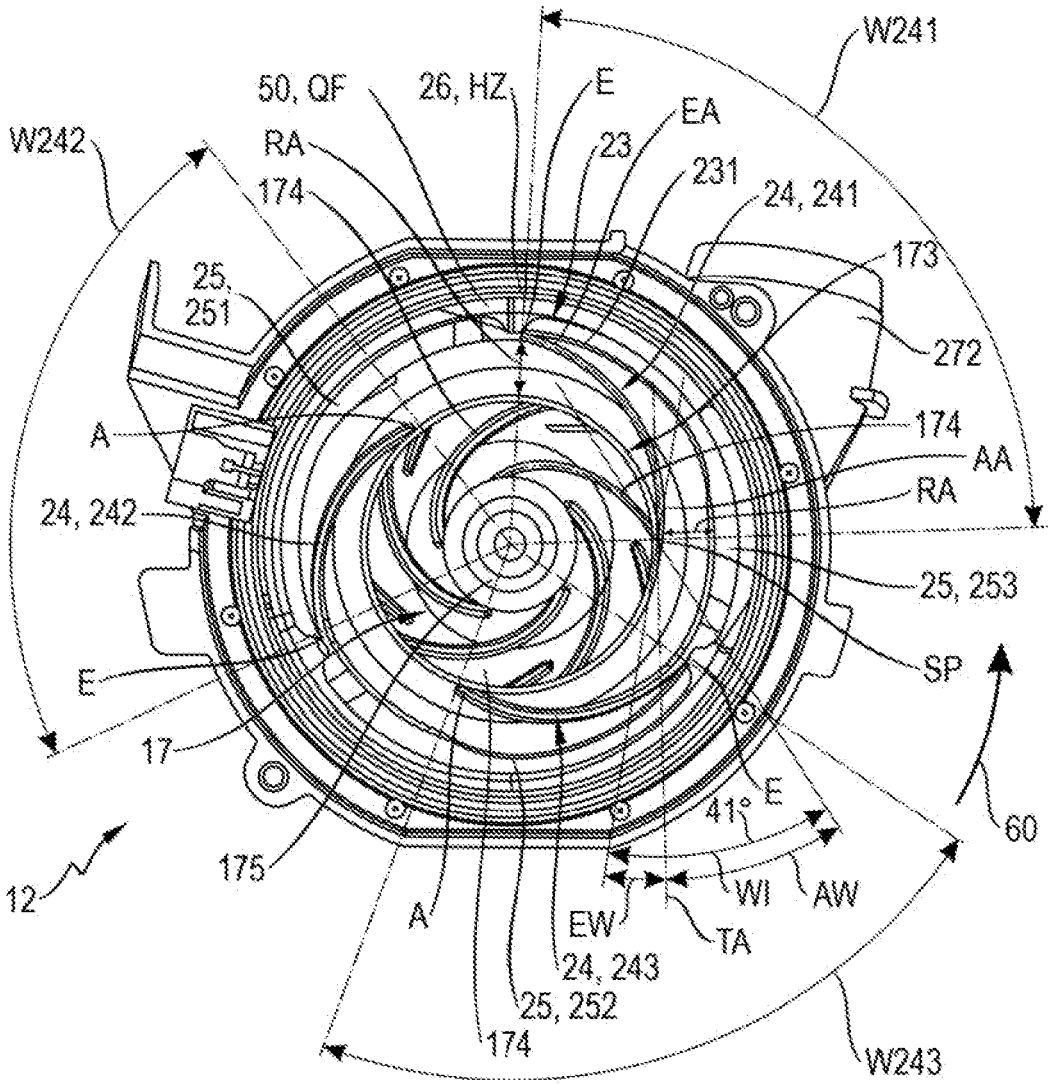
FIG. 5 shows the second housing part with the hydraulic unit of the liquid heating pump of FIG. 4 viewed in the direction of the axial outflow, wherein the rear cover disk of the impeller of the hydraulic unit viewed in the suction direction is omitted.
Figure 6:
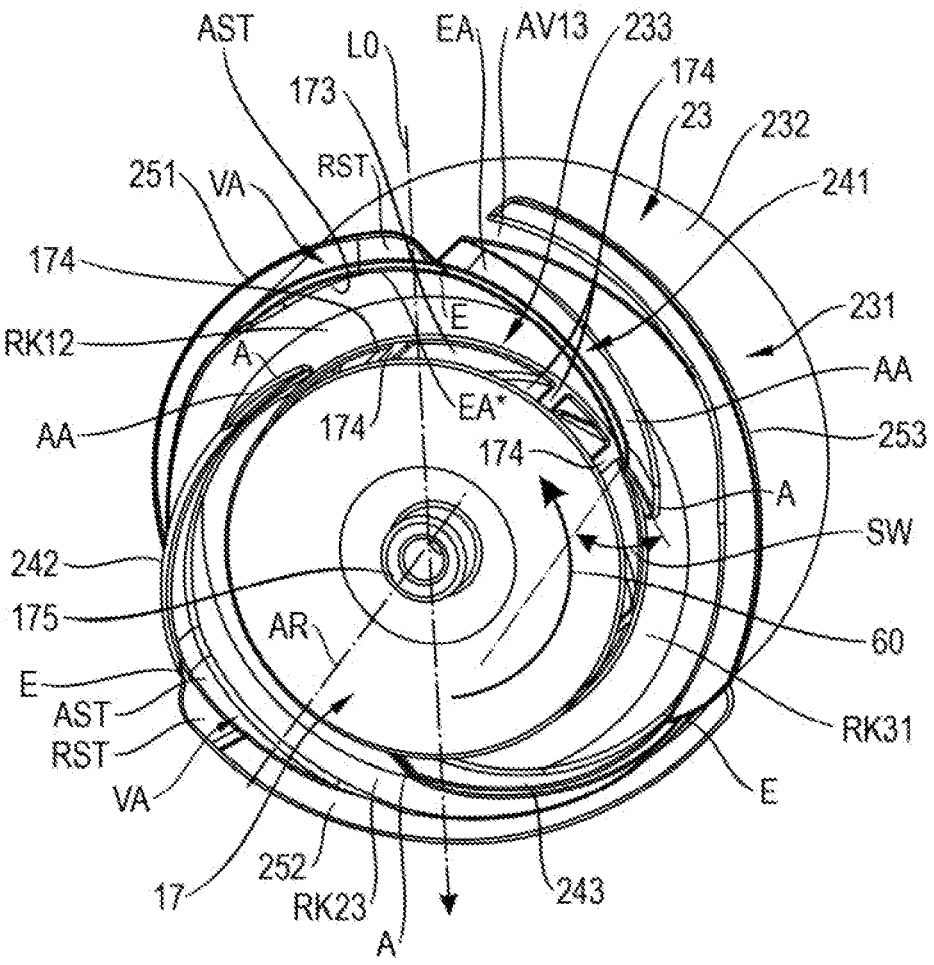
FIG. 6 shows schematically in a perspective view as a detail of the liquid heating pump of FIG. 4, the diffusor thereof together with the impeller arranged upstream of the wall on the front face thereof, viewed in the axial outflow direction.

In order to counteract a collection of air in the center of the impeller chamber 40 and/or about the hub 175 of the impeller, i.e. to prevent this as far as possible, according to the construction principle according to the invention one or more guide blade portions 24 which axially protrude in the direction of the impeller chamber 40 are provided on the front wall 233 facing the impeller chamber 40 of the preferably circular cylindrical main body 231 of the diffusor 23 in the exemplary embodiment here. In the exemplary embodiment of FIG. 2 advantageously three axially protruding guide blade portions 241, 242, 243 are attached to the front wall 233 of the main body 231 facing the impeller chamber, in particular integrally formed. FIG. 4 shows the liquid heating pump 12 of FIG. 2 schematically in a perspective view in the open state. In this case, the first housing part 28 with the preferably electrical drive unit 18 contained therein is omitted. The viewing direction is toward the front wall of the second housing part 29 facing the first housing part 28, with the hydraulic unit 19 contained therein. Corresponding to FIG. 4, FIG. 5 now shows in a front view the front wall of the open second housing part 29 of the liquid heating pump 12 of FIG. 2 facing the first housing part 28, when viewed in the axial outflow direction, wherein the rear cover disk 172 of the impeller 17 of the hydraulic unit 19, viewed in the suction direction 31, is also omitted. Finally, FIG. 6 illustrates schematically in a perspective view, as a detail of the liquid heating pump 12 of FIG. 4, the diffusor 23 thereof together with the impeller 17 arranged downstream of the wall 233 thereof on the front face (viewed in the suction direction 31).

The three axially protruding guide blade portions 241, 242, 243 are fixedly arranged on the front wall of the stationary main body 231 facing the impeller chamber in the peripheral direction, in each case offset to one another by the same centering angle of approximately 120° such that a liquid guide channel such as for example RK12 is present between two adjacent axially protruding guide blade portions, viewed in the peripheral direction, such as for example 241, 242, away from the peripheral liquid ejection region 173 of the impeller 17, said liquid guide channel in the front wall 233 of the main body 231 which faces the impeller chamber 40 leading outwardly to the axial outer casing 232 of the main body 231. As a result, three liquid guide channels RK12, RK23, RK31 are provided, starting from the outer peripheral and/or peripheral liquid ejection region 173 of the impeller 17 to the axial outer casing 232 of the main body 231. In detail, viewed in the rotational direction 60 of the impeller 17, the liquid guide channel RK12 is provided between the first axially protruding guide blade portion 241 and the second axially protruding guide blade portion 242, downstream in the peripheral direction, the liquid guide channel RK23 is provided between the second axially protruding guide blade portion 242 and the third axially protruding guide blade portion 243, downstream in the peripheral direction, and the liquid guide channel RK31 is provided between the third axially protruding guide blade portion 243 and the first axially protruding guide blade portion 241, downstream in the peripheral direction. The respective axially protruding guide blade portion 241, 242, 243 extends in this case approximately from the peripheral circle which is predetermined by the peripheral liquid ejection region 173 on the outer periphery of the impeller 17 as far as the outer periphery of the circular cylindrical main body 231. In this case, it is attached, in particular integrally formed, onto the closed cover surface 233 of the circular cylindrical main body 231 facing the impeller chamber 40, which extends between the outer periphery of the outlet opening 401 of the suction channel 16 and the outer periphery of the main body 231. Preferably it may be produced from the same plastics material as the main body 231, in this case as the circular cylindrical cover thereof. In general terms, the respective axially protruding guide blade portion is made from a single material and is integrally formed on the front face 233 of the main body 231 facing the impeller chamber 40. In this manner, the respective guide blade portion 241, 242, 243 axially protruding into the impeller chamber 40 extends inside the outer periphery of the preferably circular cylindrical main body 231 here, but not beyond the axial outer casing of the main body in the radial direction. At least its initial portion AA covers the axial width AB of the liquid outlet region 173 between the two cover disks 171, 172 of the impeller 17. Viewed in the radial direction RR, a radial gap RS which is as small as possible remains between the initial portion A of the respective axially protruding guide blade portion 241, 242, 243 and the outer periphery of the impeller. In particular, the radial gap RS is selected to be between 0.5 mm and 2 mm. As a result, circular leakage volumetric flows, which could circulate once or repeatedly around the outer periphery of the impeller 17, are substantially prevented. This improves, in particular, the volumetric efficiency of the liquid heating pump 12 constructed according to the invention. Preferably the respective axially protruding guide blade portion 241, 242, 243 covers the entire axial extent ABR of the peripheral liquid outlet region 173 along its entire extent which here in the exemplary embodiment reaches as far as the outer periphery of the circular cylindrical casing 232 of the main body 231.

The respective axially protruding guide blade portion 241, 242, 243 extends such that, viewed from its further radially inwardly located initial portion A as far as its further radially outwardly located end E, it has an oblique position of in particular between 90° and 135°, preferably of approximately 120°, relative to the radial direction RR of the impeller 17 in the rotational direction 60 thereof. As a result, it forms for the liquid ejected from the liquid ejection region 173 of the impeller 17, with a radial and circular and/or azimuthal speed component, a slope rising from the peripheral liquid outlet region 173 to the outer periphery of the axial outer casing 232, i.e. it forms a lifting aid which brings the liquid FL ejected from the impeller 17 onto a defined guide path which leads from the peripheral liquid ejection region 173 to the axial outer casing 232 of the main body 231. In particular, the respective axially protruding guide blade portion 241, 242, 243 has an arcuate shape with a direction of curvature in the rotational direction 60 of the impeller 17. This path of the respective axially protruding guide blade portion 241, 242, 243 lifts the liquid ejected from the impeller with a radial and circular directional component from the respective outlet point thereof on the peripheral liquid ejection region 173 and guides the liquid in a defined manner outwardly to an inlet on the axial outer casing 232 of the main body 231, which is different from the outlet, (viewed in the rotational direction 60) into the diffusor and/or pressure chamber 50. It is expedient, in particular, if when viewing the front wall 233 of the main body 231 of the diffusor 23 facing the impeller chamber 40, the respective axially protruding guide blade portion, such as for example 241, with its further radially inwardly located initial portion AA preferably extends outwardly, substantially tangentially, from an internal peripheral point on the circle of the liquid ejection region 173 of the impeller 17 and with its radially outwardly located end portion EA discharges substantially tangentially on an outer peripheral point on the outer peripheral circle of the axial outer casing 232 of the main body 231, which is different from this internal peripheral point. This advantageously promotes the removal of the conveyed liquid from the peripheral outer periphery of the impeller in a flow path to the axial outer casing of the main body and into the preferably circular cylindrical diffusor and/or pressure chamber, where it continues to circulate in the axial direction around the preferably circular cylindrical axial outer casing of the main body in a helical manner. In this regard, the kinetic energy provided by the rotating impeller to the liquid is partially maintained when the impeller chamber transitions into the diffusor and/or pressure chamber. To this end, in particular, it is advantageous if the respective axially protruding guide blade portion, as in the exemplary embodiment here of FIGS. 2-6, viewed in the viewing direction of the front wall 233 in the axial outflow direction, extends from its further radially inwardly arranged initial portion A to its further radially outwardly arranged end E relative thereto, in the form of an outwardly opening circular arc portion or spiral portion. It is particularly advantageous if the respective axially protruding guide blade portion extends in the form of a spiral portion, the radius of curvature thereof increasing from its further radially inwardly arranged initial portion A to its further radially outwardly arranged end E relative thereto.

The three axially protruding guide blade portions 241, 242, 243 are integrally formed on the wall 233 of the main body 231 on the front face facing the impeller chamber 40, such that in each case, viewed from their further radially inwardly located initial portion A to their further radially outwardly located end E, they extend in the peripheral direction, in each case via a predetermined centering angle range of preferably between 45° and 90° (viewed in the rotational direction 60) in the successfully tested liquid heating pump and in this case, in the plane spanned by this front wall 233 of the main body 231 or a plane parallel thereto, cover a radial slope and/or a radial distance which corresponds approximately to the radial spacing RA between the liquid ejection region 173 and the axial outer casing 232 of the main body 231. The respective axially protruding guide blade portion thus serves firstly as removal means and/or a lifting aid (in the radial direction) for the liquid FL on the outer periphery of the impeller ejected further radially inwardly therefrom, into the further outwardly located diffusor and/or pressure chamber 50, viewed radially. Secondly, the freely axially protruding guide blade portions, viewed around the outer periphery of the impeller, serve as interruption means in the peripheral direction which prevent the formation of a single or repeated 360° circular flow in the impeller chamber. In other words, they remove the liquid ejected on the outer periphery of the impeller 17 from the peripheral liquid outlet region 173 thereof, in the direction of the axial outer casing 232 of the main body 231 in a defined manner and in good time, so that it barely results in a circular flow which circulates once or repeatedly by 360°, or not at all.

In the successfully tested liquid heating pump for mass production in a household dishwasher which is constructed according to the principle according to the invention, the radial spacing RA is between 5 mm and 10 mm. The respective axially protruding guide blade portion 241, 242, 243 preferably has an axial extent of between 3 mm and 8 mm, in particular of approximately 5 mm. By the axially protruding guide blade portions 241, 242, 243 which are arranged offset to one another approximately in the peripheral direction, by the same centering angle of approximately 120°, and which in each case viewed in the peripheral direction approximately cover an angular range of between 45° and 90°, the liquid flow which flows out of the impeller 17 at the peripheral liquid outlet region 173 thereof may be acted upon substantially uniformly by a radial and circulating deflection component and, viewed in the peripheral direction, the liquid is distributed substantially uniformly into the diffusor and/or pressure chamber 50 which is circular in cross section.

In order to ensure that the liquid, which emerges from a peripheral point on the outer peripheral and/or peripheral liquid outlet region 173 of the impeller 17, is still able to pass from there along a partial angular range of a full 360° angle around the impeller in the rotational direction 60 before it is deflected and/or diverted by an axially protruding guide blade portion, positioned downstream in the rotational direction 60, in the direction of the axial outer casing, in particular as in the exemplary embodiment here advantageously to the axial outer casing 232 of the main body 231, it is expedient if the respective axially protruding guide blade portion, viewed from its further radially inwardly located initial portion A to its further radially outwardly located end E relative thereto, in the peripheral direction extends over an angular range of at least 30° and at the same time in each case in the plane spanned by the front wall 233 of the main body 231, preferably covers a radial slope RA which corresponds to the radial spacing between the liquid ejection region 173 of the impeller 17 and the axial outer casing 232 of the main body 231.

Between the imaginary, in particular tangential, extension of the radial outer end portion of the respective impeller blade 174 and the imaginary, in particular tangential, extension of the initial portion AA of the respective axially protruding guide blade portion 241, 242, 243, preferably an acute intermediate angle WI of at most 50°, in particular of between 30° and 45°, is enclosed. In the liquid heating pump successfully tested for mass production in household dishwashers, the intermediate angle WI is advantageously selected to be approximately equal to 41°. The intermediate angle WI is made up from the outlet angle AW which is enclosed between the tangential extension of the outer end portion of the respective impeller blade 174 and the tangent which at the intersection between the outer impeller blade end and the outer peripheral circle of the impeller 17 is positioned thereon, and the inlet angle EW, which is enclosed between the tangent on the initial portion AA of the respective axially protruding guide blade portion, such as for example 241, and the tangent which at the intersection of the initial portion AA of the guide blade portion, such as for example 241, with the outer peripheral circle of the impeller 17, is positioned thereon. In order to be able to lift the liquid ejected from the blades of the impeller from the outer periphery of the impeller and/or the circular liquid ejection region 173 thereof to a liquid path which leads to the axial outer casing 232 of the main body 231 and at the same time keeps losses of kinetic energy, which has been provided to the liquid by the rotational movement of the impeller blades, as low as possible or prevents losses as far as possible, the inlet angle EW is expediently selected to be less than 15°, in particular between 8 and 12°.

In this manner, the respective guide blade portion, such as for example 241, 242, 243, for the liquid ejected on the outer periphery of the impeller has a guide track and/or a guide path which, relative to the flow path thereof provided by the impeller blades, has a slighter larger pitch in order to force the liquid from the outer peripheral circle 173 of the impeller 17 away into an ascending path leading to the axial outer casing 232 of the diffusor main body. As the intermediate angle WI is selected, in particular, to be at most equal to 50°, the losses of kinetic energy may be kept low when supplying the liquid emerging from the liquid ejection region 173 to the respective axially protruding guide blade portion.

The further radially inwardly located initial portion A of the respective axially protruding guide blade portion, such as for example 241, 242, 243, expediently has a contour which is different from the contour of the outlet side end of the respective impeller blade. In this case in the exemplary embodiment of FIGS. 2-6, the initial portion A of the respective axially protruding guide blade portion extends in the form of a bevel transversely to the end contour of the outlet side end of the respective blade of the impeller. Expediently, an acute angle of SW between 20° and 60° is enclosed between the edge extending the axial direction of the outer end of the respective impeller blade and the edge of the initial portion A, positioned transversely to this impeller blade end edge, of the respective axially protruding guide blade portion. By the different contours of the impeller blade end and the initial portion of the respective axially protruding guide blade portion inadmissibly high noise excitation by the liquid ejected from the impeller and striking the initial portion A of the respective axially protruding guide blade portion is substantially prevented.

Here in the exemplary embodiment of FIGS. 2-6, additionally on the axial outer casing 232 of the main body 231, three radially protruding guide blade portions 251, 252, 253, viewed in the rotational direction 60, in each case are arranged offset to one another by approximately the same peripheral angle of preferably approximately 120°. In the liquid heating pump successfully tested for mass production, these three radially protruding guide blade portions 251, 252, 253 acting on the liquid flow in the diffusor and/or pressure chamber 50 with an axial directional component, in each case protrude radially between 2 mm and 3 mm from the axial outer casing 232 into the diffusor and/or pressure chamber 50. They extend in each case in the form of a helix portion and/or helical portion around an axial longitudinal portion of the circular cylindrical main body 231. The helix portion of the respective radially protruding guide blade portion 251, 252, 253 in this case begins at the end of the axial outer casing 232 facing the impeller chamber 40, i.e. at the axial longitudinal point of the main body, from which it extends into the axial outflow direction. In the liquid heating pump tested for mass production, the respective helical radially protruding guide blade portion has an axial pitch, preferably of between 2.5 and 3.5 cm, in particular of approximately 3 cm, on the axial outer casing. Downstream of the portion provided with the three radially protruding guide blade portions 251, 252, 253 of the circular cylindrical main body 231, viewed in the axial outflow direction, is an end portion of the main body which is free of guide blades. This has an axial length, preferably of between 2 cm-5 cm for the liquid heating pump tested for mass production.

The further radially outwardly arranged end portion EA of the respective guide blade portion axially protruding on the front face, such as for example 241 in this case in the exemplary embodiment of FIGS. 2-6 via a connecting portion VA in particular integrally formed thereon, is connected to an assigned, radially protruding guide blade portion, such as for example 251, arranged downstream on the outer casing side, viewed in the rotational direction 60 of the impeller 17. In this case, the connecting portion VA ensures a substantially continuous, uninterrupted, i.e. continual transition between the end portion EA of the guide blade portion axially protruding on the front wall 233 of the main body 231, such as for example 241, and the initial portion of the radially protruding guide blade portion, for example 251, assigned thereto on the axial outer casing 232 of the main body 231. The connecting portion VA is removed from the liquid ejection region 173 of the impeller 17 preferably by a spatial distance which approximately corresponds, viewed in a normal plane to the rotational axis, to the radial distance between the outer periphery of the impeller 17 and the outer periphery of the front wall 233. In the liquid heating pump successfully tested for mass production in household dishwashers, the connecting portion VA is preferably spatially removed between 0.8 cm and 1.2 cm from the impeller 17.

The connecting portion VA extends along an outer peripheral portion of the front wall 233 of the main body 231 facing the suction side of the impeller 17. It has an axially protruding circular arc-like projecting portion AST which, viewed in the cross-sectional plane of the front wall 233 and/or when viewing from the impeller chamber to the front wall 233, is attached, in particular integrally formed, on the outer edge of the front wall 233 along a portion of the circular arc-shaped outer periphery thereof.

Additionally on the front face of this axially protruding circular arc portion-like projecting portion AST facing the impeller chamber 40, a radially protruding projecting portion RST is attached, in particular integrally formed, along the entire length thereof. The radially protruding projecting portion RST in this case forms an edge angled at approximately 90° to the axially protruding projecting portion AST. It may be advantageous in this case, in particular, if the axial extent of the axially protruding projecting portion AST, from its end facing the axially protruding guide blade portion, such as for example 241, continuously reduces as far as its end facing the radially protruding guide blade portion, such as for example 251, on the axial outer casing side. As a result, it is possible in a structurally simple manner to lengthen the radially protruding guide blade portion on the axial outer casing side, such as for example 251, preferably corresponding to the spiral-shaped path thereof. Viewed in the plane of the front wall 233 the axially protruding projecting portion AST, however, lengthens the axially protruding guide blade portion on the front face, such as for example 241, by a circular arc portion, which is integrally formed on a peripheral edge portion of the outer periphery of the front wall. If the axially protruding guide blade portion, such as for example 241, viewed in the plane of the front wall 233 is configured to be in the manner of a spiral portion, the axially protruding projecting portion AST according to an alternative embodiment may correspondingly lengthen this spiral portion path of the axially protruding guide blade portion, such as for example 241, in the downstream direction.

In this manner, the connecting portion VA connects the axially protruding guide blade portion on the front face, such as for example 241, with the radially protruding guide blade portion assigned thereto on the axial outer casing side, such as for example 251, preferably integrally and in a single material to form a continuous guide blade. As a result, the hydraulic efficiency of the liquid heating pump constructed according to the invention and the aeration behavior thereof is particularly improved. This is because the radially protruding projecting portion RST acts counter to the axial outflow direction as a barrier and/or obstacle which hinders or prevents an axial flow of an air bubble from the diffusor and/or pressure chamber back into the impeller chamber and thus ultimately into the center of the impeller chamber, when the liquid heating pump is operating in pumping mode. The axially protruding projecting portion AST serves as an extension of the radial outer end portion of the axially protruding guide blade portion of the combined guide blade and preferably permits a continuous transition into the radially protruding guide blade portion assigned thereto on the axial outer casing side. Additionally it acts in the impeller chamber counter to the radial ejection direction of the impeller as a barrier and/or obstacle which hinders or prevents a flow of an air bubble from the diffusor and/or pressure chamber radially inwardly back into the center of the impeller chamber when the liquid heating pump is working in pumping mode.

If as here in the exemplary embodiment of FIGS. 2-6 three axially protruding guide blade portions are provided on the front face 233 of the diffusor main body 231 facing the impeller chamber 40, offset to one another by approximately 120° in the rotational direction 60, in particular the following angular distribution is expedient: the respective guide blade portion 241, 242, 243 axially protruding on the front face, viewed in the peripheral direction, extends over a centering angle range W241, W242, W243 of between 50° and 90°, its connecting portion VA viewed in the peripheral direction extends over a centering angle range of between 30° and 60°, and the radially protruding guide blade portion 251, 252, 253 assigned thereto on the axial outer casing side extends over a centering angular range of between 50° and 90°. The diffusor 23 in its installed position is expediently positioned to be aligned such that one of the three guide blade portions, such as for example the guide blade portion 241, viewed in the polar coordinate system, extends in the angular range of between 10° and 90°, its connecting portion VA extends in the angular range of between 90° and 135° and the radially protruding guide blade portion assigned thereto on the axial outer casing side, such as for example 251, extends in the angular range of between 135° and 205°. As a result, it is substantially prevented that an air bubble, in particular from the 12 o'clock region, i.e. from the upper zone of the diffusor and/or pressure chamber 50 when starting up the liquid heating pump 12 constructed according to the invention, is able to flow back into the impeller chamber 40 counter to the predetermined pump outflow direction. When viewing the front wall of the main body 231 facing the impeller chamber 40, (viewed from the impeller) the respective radially protruding guide blade portion, such as 251 for example, extends on the axial outer casing 232 of the main body 231, and its extension on the upstream side extends through the radially protruding projecting portion RST of the connecting portion VA in an outer peripheral region of the main body 231, in the gap between the radial outer end E of a first axially protruding guide blade portion, such as for example 241, and the radial outer end E of an adjacent second axially protruding guide blade portion, viewed in the rotational direction 60 of the impeller 17, such as for example 242. The radially protruding projecting portion RST of the connecting portion VA in this case produces an axial barrier for an air bubble which is located on the downstream side of the connecting portion VA in the diffusor and/or pressure chamber 50, so that in rotational operation of the impeller 17 this air bubble is prevented from flowing back into the impeller chamber 40. Such an air bubble may be present in an upper cavity of the housing part 29, in particular after a stoppage phase of the impeller of the liquid heating pump, and in the case of a conventional liquid heating pump, when starting up the impeller, this air bubble could flow back into the center of the impeller chamber (by the active centrifugal forces which project the liquid outwardly due to the greater density thereof, while by the vacuum produced in the center of the impeller chamber the air flows therein).

Viewed in the installed position of the diffusor 23, in particular, the first axially protruding guide blade portion 241 and its connecting portion VA for the first radially protruding guide blade portion 251 assigned thereto on the axial outer casing side is arranged in the upper region of the main body 231, such that they prevent any air bubble which is present above the main body 231 in the diffusor and/or pressure chamber 50 from flowing back radially inwardly in the direction of the center of the impeller chamber 30 during the rotational operation of the impeller. This is advantageous, in particular, when during start-up, i.e. when starting the impeller, an air bubble is present in an upper cavity of the second pump housing part 29, in particular in the upper region of the diffusor and/or pressure chamber 50 or the outlet 271 optionally downstream thereof.

Optionally it may be sufficient, in particular, to provide in the liquid heating pump a simplified diffusor which has only a single combined guide blade (as specified above) with an angular position in the upper region of the main body. A simple means for preventing an air bubble from flowing back into the center of the impeller chamber may even be provided thereby. In a further simplified manner, it may be sufficient, in particular, if only one single axially protruding guide blade portion is provided in the 12 o'clock region of the front face of the main body facing the impeller chamber, the circular cylindrical main body otherwise being configured on its axial outer casing without guide blades.

Returning to the exemplary embodiment of FIGS. 2-6, the respective axially protruding guide blade portion, such as for example 241, on the front wall 233 of the main body 231 facing the impeller chamber 30, terminates on the outer periphery of the main body in the peripheral position in which the upstream radially protruding guide blade portion on the axial outer casing, viewed in the rotational direction 60 of the impeller 17, such as for example 253, viewed downstream on the axial outer casing 232 of the main body 231 (in the direction of the discharge port 272) terminates with an axial spacing from the front wall 233 of the main body 231 of the diffusor 23 facing the impeller chamber 40. This ensures that by means of two tool parts and/or mold parts which may be moved in the axial direction toward one another and away from one another, the diffusor may be produced in a simple manner in a plastics injection-molding method and fault-free unmolding of the radially protruding and axially protruding guide blade portions on the main body of the diffusor is possible.

By these combined, i.e. 3D, guide blades which in each case are made up from a guide blade portion axially protruding on the front face, a connecting portion and an associated radially protruding guide blade portion, the kinematic energy provided to the liquid ejected by the impeller may be converted with a high level of efficiency into pressure. The guide blades additionally permit short transit times for air bubbles which may potentially enter the suction channel on the input side. For the liquid heating pump successfully tested for mass production, a transit time preferably of at most 6 seconds, in particular of between 3 and 6 seconds, elapses between the time when an air bubble enters the suction channel and the time when it is ejected from the discharge port.

Figure 7:
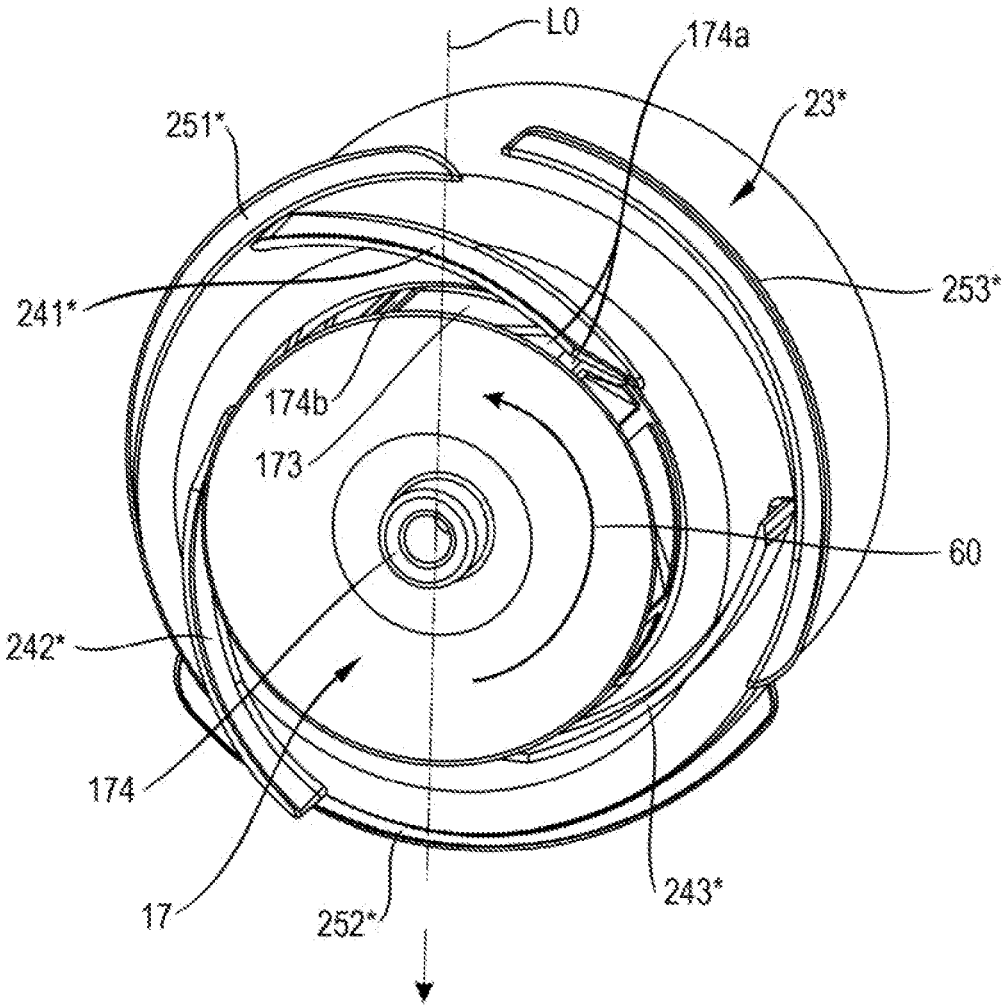
FIG. 7 shows schematically in a perspective view an advantageous modification and/or alternative of the diffusor configured according to the invention of FIG. 6, together with the impeller arranged upstream of the wall on the front face thereof, viewed in the axial outflow direction.

FIG. 7 shows schematically in a perspective view a modification of the diffusor 23 of FIGS. 2-6. The modified diffusor is denoted by 23*. Viewed in the outflow direction (i.e. in the 180° direction opposing the suction direction 31), the impeller 17 is arranged upstream of the front face thereof facing the impeller chamber. This diffusor 23* has no combined guide blades but on the front face of the main body 231 of the modified diffusor 23* facing the impeller chamber and/or the suction side, three individual separate guide blade portions 241*, 242*, 243* protrude axially in the direction of the impeller. The guide blade portions are in each case arranged offset to one another by approximately the same angle of approximately 120° in the peripheral direction. The path thereof otherwise corresponds to that of the axially protruding guide blade portions 241, 242, 243 of the diffusor 23 of FIGS. 2-6. Individual radially protruding guide blade portions 251*, 252*, 253* are provided in each case separated by a gap from the axially protruding guide blade portions 241*, 242*, 243* on the axial outer casing of the main body of the diffusor 23*. The guide blade portions have approximately the same spiral portion-shaped path as the radially protruding guide blade portions 251, 252, 253 on the axial outer casing 232 of the main body 231 of the diffusor 23 of FIGS. 2-6. The respective axially protruding guide blade portion, such as for example 241*, viewed in the peripheral direction, is positioned such that viewed in the axial direction it preferably covers the gap between a first radially protruding guide blade portion, such as for example 253*, and, viewed in the rotational direction 60 of the impeller, a downstream radially protruding guide blade portion, such as for example 251*. Also it may be substantially prevented thereby that when starting up the impeller and/or during rotational operation of the impeller an air bubble which is located in the upper, approximately 12 o'clock, region of the diffusor and/or pressure chamber is able to flow back to the center of the impeller chamber. This modified diffusor 23*, by the separate axially protruding guide blade portions 241*, 242*, 243*, and the radially protruding guide blade portions 251*, 252*, 253* separated therefrom, i.e. unconnected thereto, may be produced in a simple manner by means of two tool parts which may be moved in the axial direction toward one another and away from one another in a plastics injection-molding method. In this case, fault-free unmolding of the separate radially protruding guide blade portions and the separate axially protruding guide blade portions unconnected thereto on the main body of the diffusor is possible.

Figure 8:
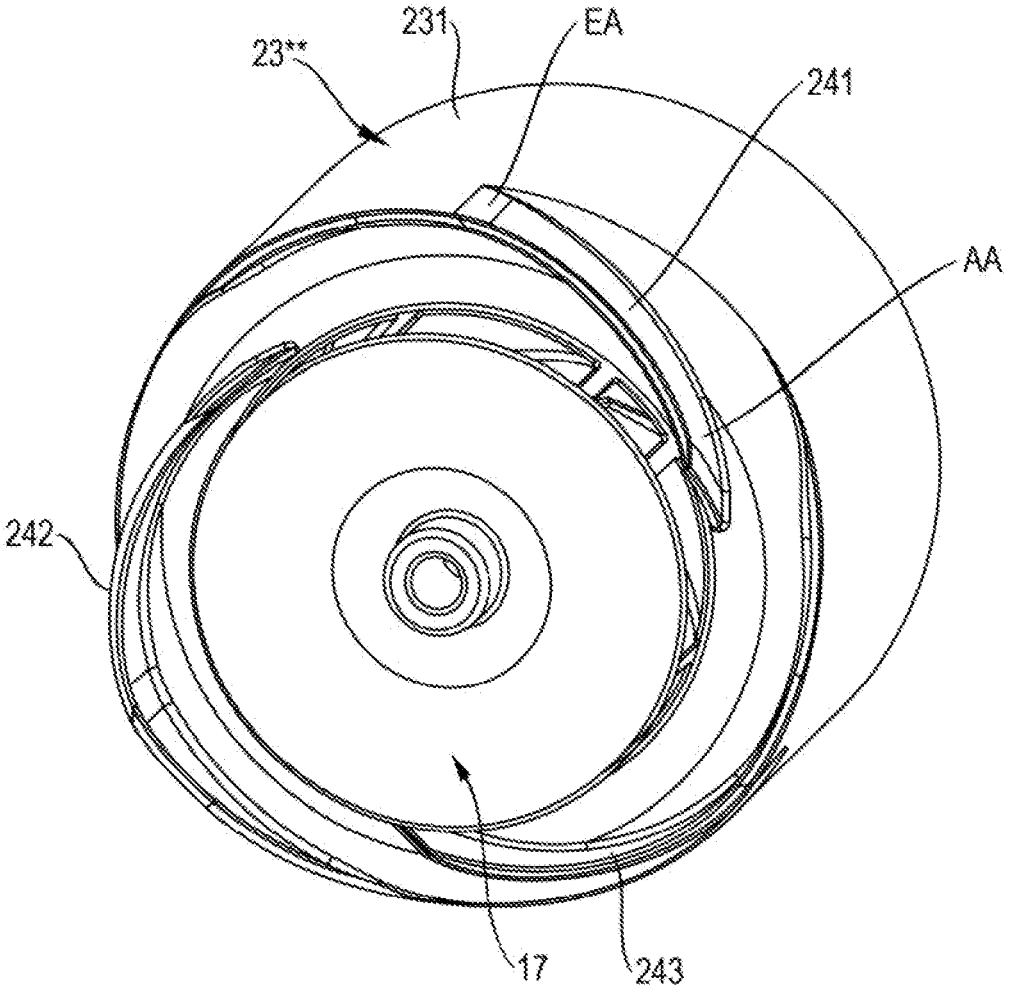
FIG. 8 shows schematically in a perspective view a further advantageous modification of the diffusor configured according to the invention of FIG. 6 with the impeller assigned on the front face.

Finally FIG. 8 shows schematically in a perspective view a second modification of the diffusor 23 of FIGS. 2-6. In this case in turn the impeller (viewed in the axial outflow direction) is illustrated upstream of the front face of the main body of the diffusor facing the impeller chamber. The modified diffusor is illustrated in FIG. 8 by 23. The guide blade portions 251-253 radially protruding on the axial outer casing of the main body are omitted therein. The diffusor has only the guide blade portions 241, 243 axially protruding into the impeller chamber 30. The respective axially protruding guide blade portion 241-243 is, in particular, configured to be enlarged by the axially protruding arcuate projecting portion AST. The respective axially protruding guide blade portion 241, 242, 243 on the front face 233 of the main body 231 facing the impeller chamber 30 in the direction of the impeller 17** protrudes on its further radially outwardly located end portion EA less in the axial direction of the impeller than on its further radially inwardly located initial portion AA. By this shape of the respective axially protruding guide blade portion, in the plane of the front face of the main body facing the impeller chamber, a lifting aid for the liquid ejected from the running impeller is provided in a simple manner on the otherwise smooth circular cylindrical axial outer casing of the main body and a barrier is provided to prevent an air bubble from flowing back radially inwardly from the diffusor and/or pressure chamber.

In a modification of the advantageous variants of FIGS. 1-8, optionally it may even be sufficient to provide only a single axially protruding guide blade portion approximately in the 12 o'clock region, i.e. in the upper region of the front wall 233 of the main body 231 of the diffusor facing the impeller chamber. Also a barrier, which is located downstream in the upper region of the diffusor and/or pressure chamber, may even be provided in the direction of gravity and/or vertical direction LO to prevent an air bubble from flowing radially inwardly back to the center of the impeller chamber. This is advantageous, in particular, when starting up the impeller.

Particularly advantageous are three axially protruding guide blade portions corresponding to the exemplary embodiments of FIGS. 2-8. These guide blade portions are preferably in each case arranged offset to one another in the peripheral direction by approximately 120°. Correspondingly, it is expedient if three radially protruding guide blade portions in each case are arranged offset by approximately 120° in the peripheral direction on the axial outer casing of the main body of the diffusor, as is the case in the exemplary embodiments of FIGS. 2-8. Due to this number, the production of the diffusor remains simple. At the same time, the liquid in the impeller chamber and diffusor and/or pressure chamber which, viewed in cross section, is configured to be circular, may be acted upon substantially uniformly.

Optionally two axially protruding guide blade portions may also be sufficient on the front face of the main body of the diffusor facing the impeller chamber. The guide blade portions then expediently subdivide the peripheral liquid outlet region, viewed around the outer periphery of the impeller, into approximately 180°—sized angular ranges. Also a circular flow may even be subdivided thereby into two 180° components so that it does not result in the formation of a circular flow which circulates around 360°.

Advantageously, there may be up to six axially protruding guide blade portions. These guide blade portions are then, in particular, in each case arranged offset to one another by approximately 60° in the peripheral direction and in each case assigned to a peripheral angular range of between 40° and 60°. Expediently, a plurality of radially protruding guide blade portions on the axial outer casing of the main body may be correspondingly assigned to these axially protruding guide blade portions.

Within the scope of the invention, in particular, the following features may also be expedient individually or in combination:

In the interior of the pump chamber, a stator and/or diffusor with guide blades is fastened fixedly in terms of rotation concentrically around the suction channel. This stator and/or this diffusor has a main body which is preferably configured to be circular cylindrical. It is, in particular, increased by expansion of its external diameter as a solid body toward the heating surface of the heating tube and/or heating pipe which preferably forms an axial partial portion or the entire portion of the outer defining wall of the diffusor and/or pressure chamber. Expediently, the main body of the diffusor is configured as a hollow body. By increasing the external diameter of the main body, the radial extent, i.e. the radial height, of the spiral-shaped axially acting guide blade portions reduces proportionally. The diffusor and/or pressure chamber which is circular in cross section and through which water and/or liquid flows, also correspondingly reduces in cross section, whereby with the same volumetric flow the flow speed in this region increases, as does the heat transfer to the cylinder wall of the heating pipe heated from outside. The water volume and/or liquid volume in the interior of the diffusor and/or pressure chamber also correspondingly reduces. By the novel geometry of the main body of the stationary stator and/or stationary diffusor on the stator, guide blades protruding in the axial direction and thus radially acting on the liquid ejected from the impeller, may be directly placed around the impeller, in particular the bladed impeller, which noticeably improve the aeration behavior of the hydraulic unit after the introduction of air, when changing the liquid and water or when changing the water distribution device. On the front wall of the main body facing the impeller chamber advantageously one or more axially protruding guide blade portions are provided, preferably in addition to one or more guide blade portions radially protruding on the axial outer casing of the main body. In this case, one respective radially protruding guide blade portion and one respective axially protruding guide blade portion assigned thereto of the stator, can preferably directly transition into one another and form a combined guide blade pair protruding axially and radially and transitioning into one another in a 3D-like manner. These additional radially acting guide blade portions which in each case protrude in the axial direction on the front face of the main body facing the impeller chamber, in particular the combined 3D-type axially radially protruding guide blade pairs, which transition into one another, provide a significant improvement with regard to the entire operating behavior of the liquid heating pump constructed according to the invention. Noise excitation of the water by the axially protruding blade edges may be reduced or prevented by beveling or rounding the blade edges on which the water flows and which face the impeller, in particular the bladed impeller. The diameter of the stator, the number, height, pitch and/or curvature of the axially and radially protruding guide blade portions and the position thereof may accordingly be optimized for the desired results. The fastening of the stator in the pump housing may take place by orienting the angular position, in particular by a latching connection, frictional welding, ultrasonic welding, laser welding, mirror welding, bonding, and/or by simple axial clamping between other components of the hydraulic unit. With an airtight seal of the stator interior from the remaining hydraulics, positive effects on hygiene, water consumption, transfer of dirty liquor and frost resistance may be anticipated. This may be implemented by additional sealing elements and by forming as a two-component plastics part or cost-effectively by welded connections. The geometry of the stator may preferably be designed such that a cost-effective production by plastics injection-molding is possible by means of simple open-closed molds without slides.

Increasing the external diameter of the main body of the diffusor results in a reduced dead space in the diffusor and/or pressure chamber for water by the displacement effect in the hydraulic chamber and a resulting reduction in the circulating water quantity, with correspondingly less transfer of dirty liquor between washing baths, and overall less water used per washing bath. The increased flow speed of the water on the heated surface of the heating device also results in an improved heat dissipation, with a reduced temperature load of the heating system, with the resulting reduced tendency to the formation of limescale deposits and hot spots. The combination of radial and axial guide blade portions improves the aeration behavior of the pump after changing the water, switching the spraying plane or in the case of spin losses. The liquid heating pump constructed according to these advantageous features, therefore, has a reduced tendency for malfunctioning in extreme operating conditions. It is also characterized by an improved efficiency of its hydraulic part and/or its hydraulic unit by optimized flow guidance. In summary, its overall performance, reliability and service life is improved. The liquid heating pump configured according to the construction principle according to the invention exhibits a low failure rate, which could be caused by limescale deposits from the water on the surface of the heating pipe on which the liquid flows. Thus the heat transfer from the heating pipe to the water is improved. An impairment of the heat transfer between the heating pipe and the water as a result of limescale deposits, and in a self-energizing manner due to "PTC effects", for example on heating conductors which are attached to the outer face of the heating pipe, and thus associated "hot spots", are reduced or prevented. At such points the heating system would otherwise malfunction, due to overheating and heat dissipation of the electrical insulating layer of the heating pipe. The hydraulic and volumetric efficiency of the liquid heating pump configured in such a manner are improved, the aeration time thereof is reduced and the water volume present therein reduced. By increasing the flow speed and optimizing the flow guidance on the surface of the heating pipe on which the liquid flows, the formation of limescale deposits may be reduced or prevented or—if limescale deposits have been formed—the removal thereof may be accelerated.

The invention claimed is:

1. A liquid heating pump for conveying and heating liquid in a household appliance which uses water, the liquid heating pump being at least one of a household dishwasher heating pump or a washing machine heating pump, said liquid heating pump comprising:

a housing having a centrally arranged suction channel for suctioning the liquid in an axial suction direction, an impeller chamber arranged axially downstream of the suction channel and receiving suctioned liquid, and a diffusor and/or pressure chamber which is arranged axially downstream of the impeller chamber, viewed counter to the suction direction, and which is arranged externally, coaxially, at least around a partial portion of the suction channel;

an impeller rotatably mounted in the impeller chamber for conveying the liquid into the diffusor and/or pressure chamber;

a stationary diffusor in the diffusor and/or pressure chamber, said stationary diffusor comprising a main body having a front wall in facing relation to the impeller chamber to form a front defining wall of the impeller chamber, said main body of the stationary diffusor including on the front wall at least one guide blade portion which axially protrudes in a direction of the impeller into a liquid ejection region of the impeller arranged around an outer periphery of the impeller, said at least one guide blade portion extending away from the liquid ejection region, positioned obliquely deviating from a radial direction in the impeller direction, toward an axial outer casing of the main body as far as the axial outer casing of the main body, which is arranged further radially outwardly than the liquid ejection region of the impeller;

a heating device operably connected to the diffusor and/or pressure chamber for heating the liquid, said heating device comprising at least one axially extending, partial portion of an external defining wall of the diffusor and/or pressure chamber, with the axial outer casing of the main body of the stationary diffusor forming at least one axially extending, partial portion of an internal defining wall of the diffusor and/or pressure chamber; and a discharge port for ejecting the liquid.

2. The liquid heating pump of claim 1, wherein the main body of the diffusor has the shape of a circular cylinder, said axial outer casing being defined by a diameter which is selected to be at least equal to 80% of an external diameter of the diffusor and/or pressure chamber.

3. The liquid heating pump of claim 1, wherein the impeller has an external diameter which is selected to be between 40% and 80% of the diameter of the axial outer casing of the main body of the stationary diffusor.

4. The liquid heating pump of claim 1, wherein the heating device, on the partial portion formed thereby or an entire portion formed thereby of the external defining wall of the diffusor and/or pressure chamber, provides an electrical surface heating load of between 30 W/cm$^2$ and 50 W/cm$^2$, said diffusor and/or pressure chamber having a cross section in a shape of an annular gap to define a cross-sectional passage surface area for heat dissipation of the electrical surface heating load, said cross-sectional passage surface area being selected to be between 8 cm$^2$ and 20 cm$^2$.

5. The liquid heating pump of claim 4, wherein the at least one guide blade portion is integrally formed on the front wall of the main body of the stationary diffusor, such that the at least one guide blade portion assumes an oblique position relative to the radial direction of the impeller in a rotational direction thereof, when viewed from a radially inwardly located initial portion to a radially outwardly located end of the at least one guide blade portion.

6. The liquid heating pump of claim 5, wherein the at least one axially protruding guide blade portion extends outwardly with the radially inwardly located initial portion tangentially away from an internal peripheral point on a circle of the liquid ejection region of the impeller, said radially outwardly located end portion opening tangentially on an outer peripheral point on an outer peripheral circle of the axial outer casing of the main body which outer peripheral point is different from the internal peripheral point.

7. The liquid heating pump of claim 4, wherein the at least one guide blade portion has a direction of curvature in a rotational direction of the impeller on the front wall of the main body of the stationary diffusor.

8. The liquid heating pump of claim 4, wherein the at least one guide blade portion extends in the form of an outwardly opening arcuate portion.

9. The liquid heating pump of claim 4, wherein the main body includes three of said at least one guide blade portion which are integrally formed on the front wall of the main body of the stationary diffusor facing the impeller chamber, such as to extend, when viewed from their radially inwardly located initial portion to their radially outwardly located end, in a peripheral direction over an angular range of between 45° and 90°, respectively, and thereby respectively cover in a plane spanned by the front wall of the main body a radial distance, which is located between the liquid ejection region of the impeller and the axial outer casing of the base body.

10. The liquid heating pump of claim 9, wherein the radial distance is between 5 mm and 10 mm.

11. The liquid heating pump of claim 4, wherein the main body includes a plurality of said axially protruding guide blade portion arranged in offset relation by approximately a same centering angle, such as to establish between two adjacent ones of the axially protruding guide blade portions, viewed in a peripheral direction, a liquid guide channel leading outwardly to the axial outer casing of the main body.

12. The liquid heating pump of claim 4, wherein the axially protruding guide blade portion has at least an initial portion, along an entire extent thereof, to cover from outside the liquid ejection region of the impeller on the outer periphery, across an axial width thereof with a remaining radial gap.

13. The liquid heating pump of claim 12, wherein the remaining radial gap is selected in a region of the initial portion to be between 0.5 mm and 2 mm.

14. The liquid heating pump of claim 4, wherein the impeller includes a blade which has an oblique position relative to the radial direction of the impeller counter to a rotational direction of the impeller.

15. The liquid heating pump of claim 14, wherein an acute intermediate angle of at most 50° is enclosed between an imaginary, tangential, extension of a radial outer end portion of the blade of the impeller and an imaginary, tangential, extension of the initial portion of the at least one guide blade portion protruding from the front wall of the main body facing the impeller chamber in an axial direction.

16. The liquid heating pump of claim 14, wherein the guide blade portion has a radially inwardly located initial portion which has a contour which is different from a contour of an end of the blade of the impeller on an outlet side.

17. The liquid heating pump of claim 4, wherein the axial outer casing of the main body of the stationary diffusor includes at least one radially protruding guide blade portion.

18. The liquid heating pump of claim 17, wherein the radially protruding guide blade portion extends in the form of a helical portion outwardly on the cylindrical main body.

19. The liquid heating pump of claim 17, wherein, when viewing in the direction of a front wall of the main body facing the impeller chamber, the radially protruding guide blade portion extends on the axial outer casing of the main body of the stationary diffusor at least in an outer peripheral region of the main body which is located between a radially outwardly arranged end of a first one of the at least one axially protruding guide blade portion and a radially inwardly arranged initial portion of a second one of the at least one axially protruding guide blade portion arranged downstream, when viewed in a rotational direction of the impeller.

20. The liquid heating pump of claim 17, further comprising an outlet, for an end portion without guide blades of the axial outer casing, between a downstream end of a first one of the at least one radially protruding guide blade portion radially protruding on an axial outer casing side, and an upstream end of a second downstream one of the at least one radially protruding guide blade portion radially protruding on the axial outer casing side, viewed in a rotational direction of the impeller, wherein in an installed position of the stationary diffusor the outlet is arranged in an upper region of the main body, approximately in the 12 o'clock position thereof.

21. The liquid heating pump of claim 17, wherein the at least one axially protruding guide blade portion is continuously connected, via a connecting portion integrally formed thereon, to a downstream one of the at least one radially protruding guide blade portion assigned thereto on an axial outer casing side, viewed in a rotational direction of the impeller, to form a combined guide blade.

22. The liquid heating pump of claim 21, wherein the connecting portion extends along an outer peripheral portion of the front wall of the main body facing the impeller chamber.

23. The liquid heating pump of claim 21, wherein the connecting portion comprises an axially protruding, circular arc projecting portion, and a projecting portion protruding radially in a helical manner, on an axial front face of the axially protruding, circular arc projecting portion.

24. The liquid heating pump of claim 23, wherein the axially protruding, circular arc projecting portion has an axial extent which reduces continuously from an initial portion connected to the at least one axially protruding guide blade portion as far as an end connected to the at least one radially protruding guide blade portion on the axial outer casing side.

25. The liquid heating pump of claim 21, wherein, when viewed on a front wall of the main body facing the impeller chamber, the at least one guide blade portion radially protruding on the axial outer casing of the main body of the stationary diffusor and an upstream extension formed by the radially protruding projecting portion of the connecting portion extends in an outer peripheral region of the main body in a gap between a radial outer end of a first one of the at least one axially protruding guide blade portion and a radial outer end of a second adjacent one of the at least one axially protruding guide blade portion, viewed in the rotational direction of the impeller.

26. The liquid heating pump of claim 21, wherein, viewed in an installed position of the diffusor, the at least one axially protruding guide blade portion and the connecting portion to the at least one radially protruding guide blade portion assigned thereto on the axial outer casing side, are arranged in an upper region of the front wall of the main body facing the impeller chamber such that an air bubble which may be present above the main body in the diffusor and/or pressure chamber is prevented from flowing back inwardly in a direction of a center of the impeller chamber in a rotational operation of the impeller.

27. The liquid heating pump of claim 17, wherein the at least one guide blade portion axially protruding on the front wall of the main body facing the impeller chamber, terminates on an outer periphery of the main body, in a peripheral position in which an upstream one of the at least one radially protruding guide blade portion on an axial outer casing side, viewed in the rotational direction of the impeller, terminates on the axial outer casing of the main body, viewed downstream, with an axial spacing from the front wall of the main body of the stationary diffusor facing the impeller chamber.

28. The liquid heating pump of claim 1, wherein the front wall of the main body of the diffusor has a radial outer edge zone which is configured to transition into an axial longitudinal extent of the axial outer casing of the main body in the form of a rounded portion.

29. The liquid heating pump of claim 1, wherein the heating device has an initial portion which viewed in an axial outflow direction counter to the axial suction direction is arranged in the impeller chamber.

30. A household appliance which uses water, the household appliance being at least one of a household dishwasher or a household washing machine, comprising a liquid heating pump, said liquid heating pump comprising a housing having a centrally arranged suction channel for suctioning the liquid in an axial suction direction, an impeller chamber arranged axially downstream of the suction channel and receiving suctioned liquid, and a diffusor and/or pressure chamber which is arranged axially downstream of the impeller chamber, viewed counter to the suction direction, and which is arranged externally, coaxially, at least around a partial portion of the suction channel, an impeller rotatably mounted in the impeller chamber for conveying the liquid into the diffusor and/or pressure chamber, a stationary diffusor in the diffusor and/or pressure chamber, said stationary diffusor comprising a main body having a front wall in facing relation to the impeller chamber to form a front defining wall of the impeller chamber, said main body of the stationary diffusor including on the front wall at least one guide blade portion which axially protrudes in a direction of the impeller into a liquid ejection region of the impeller arranged around an outer periphery of the impeller, said at least one guide blade portion extending away from the liquid ejection region, positioned obliquely deviating from a radial direction in the impeller direction, toward an axial outer casing of the main body as far as the axial outer casing of the main body, which is arranged further radially outwardly than the liquid ejection region of the impeller, a heating device operably connected to the diffusor and/or pressure chamber for heating the liquid, said heating device comprising at least one axially extending, partial portion of an external defining wall of the diffusor and/or pressure chamber, with the axial outer casing of the main body of the stationary diffusor forming at least one axially extending, partial portion of an internal defining wall of the diffusor and/or pressure chamber, and a discharge port for ejecting the liquid.

* * * * *